US006328404B1

(12) United States Patent
Fujimori

(10) Patent No.: US 6,328,404 B1
(45) Date of Patent: Dec. 11, 2001

(54) PRINTING APPARATUS, PRINTER INCLUDED IN PRINTING APPARATUS, AND METHOD OF PRINTING

(75) Inventor: Yukimitsu Fujimori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/494,436

(22) Filed: Jan. 31, 2000

(30) Foreign Application Priority Data

Feb. 5, 1999 (JP) ..... 11-028500

(51) Int. Cl.[7] ..... B41J 2/21
(52) U.S. Cl. ..... 347/15; 347/43; 358/1.2
(58) Field of Search ..... 347/12, 15, 40, 347/43; 358/1.2, 502

(56) References Cited

U.S. PATENT DOCUMENTS

| | | | | |
|---|---|---|---|---|
| 4,642,653 | * | 2/1987 | Ito et al. | 347/15 |
| 4,969,052 | * | 11/1990 | Ishida et al. | 358/457 |
| 5,032,851 | * | 7/1991 | Yoshimura | 347/43 |
| 5,758,034 | * | 5/1998 | Loce et al. | 358/1.2 |
| 5,818,488 | * | 10/1998 | Tanuma et al. | 347/130 |
| 6,189,993 | * | 2/2001 | Mantell | 347/15 |

FOREIGN PATENT DOCUMENTS 1-235655 9/1989 (JP) .
1-235656 9/1989 (JP) .

* cited by examiner

*Primary Examiner*—Thinh Nguyen
*Assistant Examiner*—Lamson D. Nguyen
(74) *Attorney, Agent, or Firm*—Oblon, Spivak, McClelland, Maier & Neustadt, P.C.

(57) ABSTRACT

A multilevel ink jet printer of the present invention has a greater number of tone values expressible in the respective pixels included in an image and effectively prevents the occurrence of banding. The ink jet printer of the invention enables successive ejection of ink droplets in each pixel in the course of main scan. The number of times of ink ejection in each pixel is set according to the tone value expressed in the pixel. The technique of the present invention shifts the hitting positions of the successively ejected ink droplets in a main scanning direction and thereby creates a flat dot having a longitudinal axis in the main scanning direction. The dot pitch in a sub-scanning direction is set to be sufficiently smaller than a dimension of the flat dot in the sub-scanning direction. The dot pitch in the main scanning direction is, on the other hand, set to be sufficiently smaller than a dimension of the flat dot in the main scanning direction, in such a manner that the total number of pixels included in the image does not exceed a predetermined value, which is specified according to a printing speed. Creation of dots at the preset dot pitches enables an image having rich tone expression to be printed at a high speed without causing the banding.

9 Claims, 15 Drawing Sheets

| RESOLUTION (MAIN, SUB) | TONE VALUE | DATA CAPACITY | NUMBER OF PASSES |
|---|---|---|---|
| 720×720 | 2 | 518400B | 1 |
| 720×360 | 4 | 518400B | 2 |
| 360×720 | 4 | 518400B | 1 |

PRINTING APPARATUS, PRINTER INCLUDED IN PRINTING APPARATUS, AND METHOD OF PRINTING

BACKGROUND OF THE INVENTION

1. Field of the Invention

The present invention relates to a printing apparatus that enables dots to be created in pixels arranged in a two-dimensional array and thereby prints an image on a printing medium. More specifically the invention pertains to a printing apparatus that significantly varies the maximum dimensions of the dot in two different directions that define the two-dimensional array.

2. Description of the Related Art

Ink jet printers, which create dots with several color inks ejected from a plurality of nozzles formed in a print head and thereby record an image, have been proposed as the output apparatus of the computer. The ink jet printers are widely used to print images processed by the computer in a multi-color, multi-tone expression. This printer generally allows expression of only two levels, that is, the dot on level and the dot off level, with regard to each pixel. The printer accordingly expresses the various tones of original image data by dispersion of dots.

One proposed technique reduces the weight of ink to create each dot, in order to ensure rich tone expression and high-quality printing in binary dot printers having only two levels with regard to each pixel. Creation of each dot by a reduced weight of ink enables an increase in number of dots possibly formed per unit area. This increases the number of tones expressible per unit area. The binary dot printer of this proposed technique, however, has the lowered printing speed, while enabling the rich tone expression.

Multilevel printers that enable tone expression of three or greater levels have been proposed as the technique of ensuring the rich tone expression as well as the improved printing speed. Examples of such multilevel printers include a printer that varies the quantity of ink or the density of ink to enable expression of three or more different densities with regard to each dot and a printer that enables a plurality of dots to be created in an overlapping manner in each pixel for multi-tone expression.

In the case of printing an image by a two-dimensional array of dots, the ideal shape of the dot is a circle to equalize the granularity of a resulting printed image in every direction. The quantity of ink ejected to form a substantially circular dot is rather fixed for each nozzle. In the case of formation of the substantially circular dots, there is accordingly a restriction in variation of the tone value expressible in each pixel by varying the quantity of ink ejected from the nozzle. In the binary dot printer using a single type of dot, there is a restriction in variation of the area of the dot formed according to the printing mode.

SUMMARY OF THE INVENTION

One object of the present invention is thus to provide a printing apparatus that enables expression of densities in a wide range and thereby attains high quality printing with excellent tone expression.

Another object of the present invention is to provide a printing apparatus that enables an adequate dot selected among various types of dots to be created in each pixel according to the purpose of printing.

At least part of the above and the other related objects is attained by a printing apparatus that forms dots at a preset resolution in pixels arranged in a two-dimensional array, thereby printing an image on a printing medium. The printing apparatus includes: a print head that creates a flat dot having a significantly smaller maximum dimension in a first direction of the two-dimensional array than a maximum dimension in a second direction of the two-dimensional array; a data setting unit that sets image data at the preset resolution; and a dot creation unit that drives the print head based on the image data set by the data setting unit, and creates dots at the preset resolution. The resolution is set in the first direction to satisfy a condition that an interval between adjoining dots in the first direction does not exceed the maximum dimension of the flat dot in the first direction, and is set in the second direction to satisfy a condition that an interval between adjoining dots in the second direction does not exceed the maximum dimension of the flat dot in the second direction and that the resolution in the second direction is lower than the resolution in the first direction.

The printing apparatus of the present invention intentionally adopts the flat dot, which is explicitly different in shape from the substantially circular dot. This arrangement enables a greater number of different types of dots to be used for printing, compared with the prior art printing apparatus. For example, the large dot having a greater quantity of ink than the allowable quantity for the substantially circular dot may be formed in the printing mode of the improved printing speed. In the case where the quantity of ink is extremely large, the ejected ink droplet from the nozzle may be split to hit at two different positions on the printing medium. The printing apparatus of this embodiment allows formation of such dots. The arrangement of the invention also allows misplacement of hitting positions of ink droplets in the case of ejecting a plurality of ink droplets in each pixel.

The printing apparatus of the present invention uses the flat dot, which is clearly different in shape from the substantially circular dot, in order to increase the possible options of dot type applicable for printing. This arrangement enables the adequate type of dot to be used according to the purpose of printing. The technique of the invention increases the number of different printing modes provided in the printing apparatus and enables a single print head to be used for plural printing apparatuses of different purposes.

The flat dot is defined by the dimensions of the whole shape formed by the total quantity of ink ejected in each pixel on the printing medium. For example, when the ejected ink droplet is split to hit at two different positions as shown in FIG. 19, each split of the ink droplet may form a dot of substantially circular shape. A dimension WDS in one direction of the whole shape formed by the total ink droplet is, however, significantly different from a dimension WDM in the other direction. The whole shape is accordingly regarded as the flat dot. Another technique called the area tone expression divides one pixel into a plurality of pixel divisions and varies the number of dots of substantially circular shape formed in the respective pixel divisions, in order to enable expression of plural tones in the pixel. FIG. 20 shows one example of this technique. In this case, the maximum dimension of the whole shape in one direction is significantly different from that in the other direction, so that the whole shape is regarded as the flat dot.

In the specification hereof, the pixels are defined according to the image data that specify the dot on-off levels. In the case of the area tone expression shown in FIG. 20, the pixel divisions shown by the dotted lines may be treated as individual pixels. The dot on-off level in each of these pixel divisions is set according to each piece of data included in the image data. In the specification hereof, a set of such pixel divisions, that is, a part shown by the solid line in FIG. 20, is referred to as the pixel. In a similar manner, even when a plurality of ink droplets are formed in one pixel, the whole shape formed by the total quantity of ink ejected in the pixel is referred to as the dot.

The printing apparatus of the present invention carries out the printing operation at the resolution set according to the shape of the flat dot defined as discussed above. The printing apparatus of the present invention using the flat dot ensures the high quality printing as well as the rich tone expression without causing the banding due to the clearance between adjoining dots, as described below in detail.

The following describes the conventional method of setting the resolution in a prior art printing apparatus and the effects of the present invention. FIG. 16 shows a prior art method of setting the resolution, where each circle represents a dot and each rectangle of the dotted line represents a pixel. The right side of FIG. 16 shows a 4×4 array of dots. The substantially circular dot is used in the prior art technique, because of the advantage that homogeneous granularity in every direction is attained by the substantially circular dots arranged in a two-dimensional array. The resolution is accordingly set on the premise of the use of the substantially circular dot. The prior art technique determines a diameter DD of the substantially circular dot based on the quantity of ink used for creation of the dot and sets the resolution to satisfy a condition that a diagonal length LC of the pixel is sufficiently smaller than the diameter DD of the dot. The printing operation at the preset resolution creates dots without causing any significant clearance between adjoining dots. The prior art technique may enhance the resolution in the main scanning direction to attain the printing at the higher resolution, after setting the lower limit of the resolution based on the shape of the substantially circular dot.

FIG. 17 shows application of the prior art technique of setting the resolution to the printing apparatus of the invention creating the flat dot. In this example, a dimension WDS of a flat dot in one direction is significantly different from a dimension WDM of the flat dot in the other direction as clearly shown in FIG. 17. The flat dot shown in FIG. 17 has substantially the same area as that of the substantially circular dot shown in FIG. 16. When the resolution is set according to the quantity of ink to create each flat dot, the pixel is defined as shown by the doted line in FIG. 17. The size of this pixel shown in FIG. 17 is substantially the same as the size of the pixel shown in FIG. 16. The right side of FIG. 17 shows a 4×4 array of dots formed at the preset resolution. Provided that the dot creating positions are normally aligned, the dots are formed without any significant clearance between adjoining dots.

Misalignment of the dot creating positions, however, often occurs in the sub-scanning direction. FIG. 18 shows the case of misalignment of the dot creating positions. The encircled numerals represent numbers allocated to nozzles Nz formed on a print head HD. The right side of FIG. 18 shows an array of dots formed by the print head HD. The nozzles Nz of the print head HD arranged in the sub-scanning direction tend to have varied ink ejection properties, because of their mechanical errors in manufacture. In the example of FIG. 18, the directions of ink ejection from the No. 2 nozzle and the No. 3 nozzle are varied from the normal alignment. The variation in ink ejecting direction shifts the position of the raster line formed by the nozzle. This causes the banding, that is, a clearance between adjoining dots like a rectangle BDG of the dotted line shown in FIG. 18. As clearly understood from FIG. 17, the technique of setting the resolution according to the quantity of ink reduces the overlapped area of the flat dots adjoining to each other in the sub-scanning direction. This readily causes the banding even in the case of a slight variation in ink ejecting direction as shown in FIG. 18.

FIG. 18 shows the example of creating dots with the print head HD having the plurality of nozzles Nz. In the case of creating dots with only one nozzle, the variation in feed of the nozzle in the vertical direction of FIG. 18 may cause the banding. The banding remarkably damages the picture quality of the resulting printed image. The 'significant' difference between the dimension WDS and the dimension WDM of the flat dot does not make the dot pitch in the direction of the shorter dimension of the flat dot sufficiently narrow to prevent the occurrence of the banding when the resolution is set only according to the quantity of ink.

In the printing apparatus of the present invention, the resolution in the direction of the shorter dimension of the flat dot is set to make the dot pitch in that direction sufficiently narrower than the shorter dimension WDS of the flat dot. Similarly the resolution in the direction of the longer dimension of the flat dot is set to make the dot pitch in that direction sufficiently narrower than the longer dimension WDM of the flat dot. The technique of the present invention accordingly sets the resolution in the two different directions according to the shape of the flat dot. The printing apparatus of the present invention creates dots at the preset resolution. This effectively prevents any clearance from being observed between adjoining flat dots in the respective directions, that is, prevents the occurrence of the banding.

In the printing apparatus of the present invention, the resolution in the direction of the longer dimension of the flat dot is lower than the resolution in the direction of the shorter dimension of the flat dot. The technique of setting the resolution according to the shape of the flat dot effectively prevents the adjoining flat dots in the direction of the longer dimension of the flat dot from being overlapped in an excessive manner and thereby prevents blotting and color mixing at the overlapped portions of the adjoining flat dots. This ensures the high quality printing.

The technique of setting the lower resolution in the direction of the longer dimension of the flat dot desirably reduces the number of pixels in that direction, thereby not increasing the total number of pixels in the whole image. This arrangement attains the high quality printing without lowering the printing speed. FIGS. 17 and 18 regard the example of creating the flat dots having the longitudinal axis in the horizontal direction. This arrangement is, however, applicable to any flat dots having the longitudinal axis in any direction of the dot array.

In accordance with one preferable application of the present invention, the print head creates at least two variable-size dots that have different areas and include the flat dot as a maximum area dot.

The printing apparatus of this application creates the at least two variable-size dots having different areas and thus enables expression of density in the three or more different levels with regard to each pixel. The flat dot discussed above is the maximum area dot out of the at least two variable-size dots. The printing apparatus of the present invention intentionally uses the flat dot, which is explicitly different in shape from the substantially circular dot, so as to enable the expression of densities in a wider range with regard to each pixel, compared with the prior art printing apparatus. In the case of the print head that varies the quantity of ink ejected in each pixel, this arrangement enables the variation in quantity of ink to exceed the allowable range for the substantially circular dot. The printing apparatus of the present invention using the flat dot, which is clearly different in shape from the substantially circular dot, extends the range of variation in total quantity of ink ejected in each pixel, thereby enabling the expression of densities in a wider range. This ensures the high quality printing with the rich tone expression.

In accordance with another preferable application of the present invention, the printing apparatus further includes: a main scanning unit that moves the print head forward and backward in a predetermined direction; and a sub-scanning unit that moves the printing medium relative to the print head in another direction that crosses the predetermined direction. In this application, the predetermined direction is coincident with the second direction, and the another direction is coincident with the first direction.

In the printing apparatus of this application, the flat dot is formed to have the longer dimension in the direction of the forward and backward movement of the print head, that is, in the main scanning direction, and to have the shorter dimension in the direction of the relative movement of the printing medium, that is, in the sub-scanning direction. In such a printing apparatus, the moving speed of the print head in the main scanning direction facilitates the formation of the flat dot having the longitudinal axis in the main scanning direction. This arrangement ensures the high quality printing without much difficulties.

In many cases, the banding occurs between rows of dots aligned in the main scanning direction, that is, between raster lines. The printing apparatus of the above application forms the flat dot to have the shorter dimension in the sub-scanning direction. This enhances the resolution in the sub-scanning direction and thereby effectively prevents the occurrence of the banding.

In accordance with one preferable application of the printing apparatus, the resolution in the second direction is set to satisfy a condition that a quantity of data for specifying a dot on-off level with regard to all the pixels included in the image is not greater than a predetermined value, which is based on a printing speed.

This arrangement enables an image to be printed at a desired printing speed. One of the factors affecting the printing speed is the quantity of data specifying the dot on-off levels. An increase in quantity of data lengthens the time required for preparing the data of printing and accordingly lowers the printing speed. The quantity of data depends upon the number of pixels included in the image and the quantity of information required for each pixel to specify the dot on-off level. An increase in number of pixels and an increase in number of densities expressible in each pixel increase the quantity of data.

In the printing apparatus of the present invention creating the flat dot, the quantity of information required for each pixel is determined according to the type of the dot created by the print head. The number of pixels in the direction of the shorter dimension of the flat dot is set in a specific range that prevents the occurrence of the banding. There is, however, a certain degree of freedom in the process of setting the number of pixels in the direction of the longer dimension of the flat dot. In the printing apparatus of the above application, the number of pixels in the direction of the longer dimension of the flat dot is set to make the quantity of data not greater than a predetermined value, which is specified according to the printing speed. This arrangement enables the printing at a desired printing speed. The printing apparatus of this application thus ensures the high quality printing at a high speed.

The predetermined value according to the printing speed may be set experimentally or analytically by taking into account the rate of preparation of the printing data, the rate of data transfer in the printing apparatus, and the resolution in the direction of the shorter dimension of the flat dot. There is no absolute standard of the printing speed, according to which the predetermined value is set. The printing speed may be a user's allowable value selected among some options of the printing speed proposed in the printing apparatus.

In the printing apparatus of the present invention, the flat dot may be formed by a variety of methods as discussed above. It is, however, desirable that the flat dot is formed by driving the print head a plurality of times with regard to each pixel.

This arrangement enables dots of various ink quantities to be formed, irrespective of the maximum quantity of ink ejected from the nozzle by one action. This enables expression of wider range of tone values with regard to each pixel and thereby attains the high quality printing. It is further desirable to form the flat dot by driving the print head a plurality of times with regard to each pixel in one pass of the main scan. This arrangement facilitates the formation of the flat dot having the longitudinal axis in the main scanning direction. This enables formation of the flat dot without increasing the number of passes of the main scan required for creating a dot in each pixel, thereby not lowering the printing speed.

In accordance with another application of the printing apparatus, the data setting unit sets a dot on-off level with regard to the respective pixels at the preset resolution according to an error diffusion method, which diffuses divisions of an error both in the first direction and in the second direction without any extreme difference.

The error diffusion method is a known halftoning process to determine the dot on-off level with regard to each pixel. This halftoning technique diffuses a tone error, which occurs in each pixel based on the result of the determination of the dot on-off level, to peripheral unprocessed pixels, so as to minimize the tone error as a whole. Another halftoning process, for example, the dither method, may be applicable to the printing apparatus of the present invention. Application of the error diffusion method, however, ensures the high quality printing.

The error diffusion method adopted in the printing apparatus of the present invention diffuses divisions of the error both in the first direction and in the second direction without any extreme difference. As described previously, in the printing apparatus of the present invention, the different values are set to the resolution in these two directions. In this case, the diffusion of the error in the range defined by substantially the same number of pixels in these two directions results in a difference in area of error diffusion between the two directions. The arrangement of the above application takes into account the difference in resolution and diffuses the error in the range defined by the substantially equal distance in these directions. This enables the high quality printing with a less variation in error in either direction.

The definition of the 'extreme difference' and the 'substantially equal distance' may be varied according to the effect of the error diffusion on the picture quality. It is determined that there is an 'extreme difference' in the case where the difference in area of error diffusion between the two directions results in different error variations of a printed image in the two directions and deteriorates the picture quality of the printed image. Even if the error is not diffused to the strictly equal distances in the two directions, on the contrary, in the case where the difference does not significantly affect the picture quality, it is determined that the error is diffused to the 'substantially equal distance'.

In the case where the same value is set to the resolution in the two directions, the adequate range of error diffusion attaining the favorable picture quality is known in the art. The range of error diffusion in the printing apparatus of the present invention may be set, based on this reference range of error diffusion. The reference range of error diffusion is extended in either one of the two directions according to the ratio of the resolution in the first direction to the resolution in the second direction. This technique enables the adequate range of error diffusion attaining the favorable picture quality to be set in the case where the different values are set to the resolution in the two directions.

In accordance with another preferable application of the present invention, the printing apparatus further includes: a storage unit that stores the preset resolution for each type of the printing medium; and a detection unit that detects the type of the printing medium, wherein the resolution is set according to the type of the printing medium by referring to the storage unit.

The shape of the dot formed by ejection of ink on the printing medium depends upon the ink absorption capacity of the printing medium. When a fixed quantity of ink is used to create each dot, the dot has a greater area on the printing medium that easily blots than on the printing medium that does not readily blot. In the printer medium that easily blots, even the pixels of relatively large dimensions do not cause any significant clearance between adjoining dots, that is, the banding. In this printing medium, formation of dots in the pixels of relatively small dimensions may cause blotting and color mixing on the overlapped portions of adjoining dots and deteriorate the picture quality of the resulting printed image. The adequate dimensions of the pixels to attain the high quality printing depends upon the type of the printing medium. The printing apparatus of the above application detects the type of the printing medium and creates the dots in the pixels of preset dimensions according to the type of the printing medium. This arrangement enables the high quality printing according to the type of the printing medium.

Another application of the present invention is a printer that has a main configuration identical with that of the printing apparatus of the present invention discussed above.

The present invention is thus directed to a printer that creates dots and thereby prints an image on a printing medium. The printer includes: a print head that creates at least two variable-size dots that have different areas and include, as a maximum area dot, a flat dot having a significantly smaller maximum dimension in a first direction of the two-dimensional array than a maximum dimension in a second direction of the two-dimensional array; and a driving unit that drives the print head to form dots at a preset resolution in a two-dimensional array. The resolution is set in the first direction to satisfy a condition that an interval between adjoining dots in the first direction does not exceed the maximum dimension of the flat dot in the first direction, and is set in the second direction to satisfy a condition that an interval between adjoining dots in the second direction does not exceed the maximum dimension of the flat dot in the second direction and that the resolution in the second direction is lower than the resolution in the first direction.

The printer of the present invention receives image data at the preset resolution, which is based on the shape of the flat dot, and prints a resulting image at the preset resolution. The printer exerts the same effects as those discussed above in the printing apparatus of the present invention, and accordingly ensures the high quality printing.

The present invention is also directed to a method of forming dots at a preset resolution in pixels arranged in a two-dimensional array and thereby printing an image on a printing medium, with a print head that creates at least two variable-size dots having different areas, wherein the at least two variable-size dots include, as a maximum area dot, a flat dot having a significantly smaller maximum dimension in a first direction of the two-dimensional array than a maximum dimension in a second direction of the two-dimensional array. The method includes the steps of: (a) setting image data at the preset resolution; and (b) driving the print head based on the image data set in the step (a) and creating dots at the preset resolution, wherein the resolution is set in the first direction to satisfy a condition that an interval between adjoining dots in the first direction does not exceed the maximum dimension of the flat dot in the first direction, and is set in the second direction to satisfy a condition that an interval between adjoining dots in the second direction does not exceed the maximum dimension of the flat dot in the second direction and that the resolution in the second direction is lower than the resolution in the first direction.

The printing method of the present invention exerts the same effects as those discussed above in the printing apparatus of the present invention, and accordingly ensures the high quality printing. The variety of arrangements in the printing apparatus of the present invention discussed above may be applicable to the printing method.

The principle of the present invention may be attained by a variety of other applications. One possible application is a method of designing the printing apparatus discussed above. The present invention is thus directed to a method of designing a printing apparatus that forms dots at a preset resolution in pixels arranged in a two-dimensional array and thereby prints an image on a printing medium, with a print head that creates at least two variable-size dots having different areas. The method includes the steps of: (a) setting the at least two variable-size dots, which include, as a maximum area dot, a flat dot having a significantly smaller maximum dimension in a first direction of the two-dimensional array than a maximum dimension in a second direction of the two-dimensional array; (b) setting the resolution in the first direction to satisfy a condition that an interval between adjoining dots in the first direction does not exceed the maximum dimension of the flat dot in the first direction; and (c) setting the resolution in the second direction to satisfy a condition that an interval between adjoining dots in the second direction does not exceed the maximum dimension of the flat dot in the second direction and that the resolution in the second direction is lower than the resolution in the first direction.

The printing apparatus of the present invention discussed above may be designed according to this method. Similarly the printer of the present invention may also be designed according to this method. Since the design is the first process of manufacture, the present invention may be constructed as a method of manufacturing the printing apparatus, which includes the design steps described above and the steps of actually manufacturing the printing apparatus based on the design settings.

The printing apparatus of the present invention and the corresponding method of printing may be actualized by a computer. Another application of the present invention is thus a recording medium, in which programs for actualizing the printing apparatus or the corresponding method of printing are recorded in a computer readable manner. Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Still another application of the invention is a program supply apparatus that supplies such programs to the computer via a communication path.

These and other objects, features, aspects, and advantages of the present invention will become more apparent from the following detailed description of the preferred embodiment with the accompanying drawings.

DESCRIPTION OF THE PREFERRED EMBODIMENT (1) Structure of Apparatus

Figure 1:
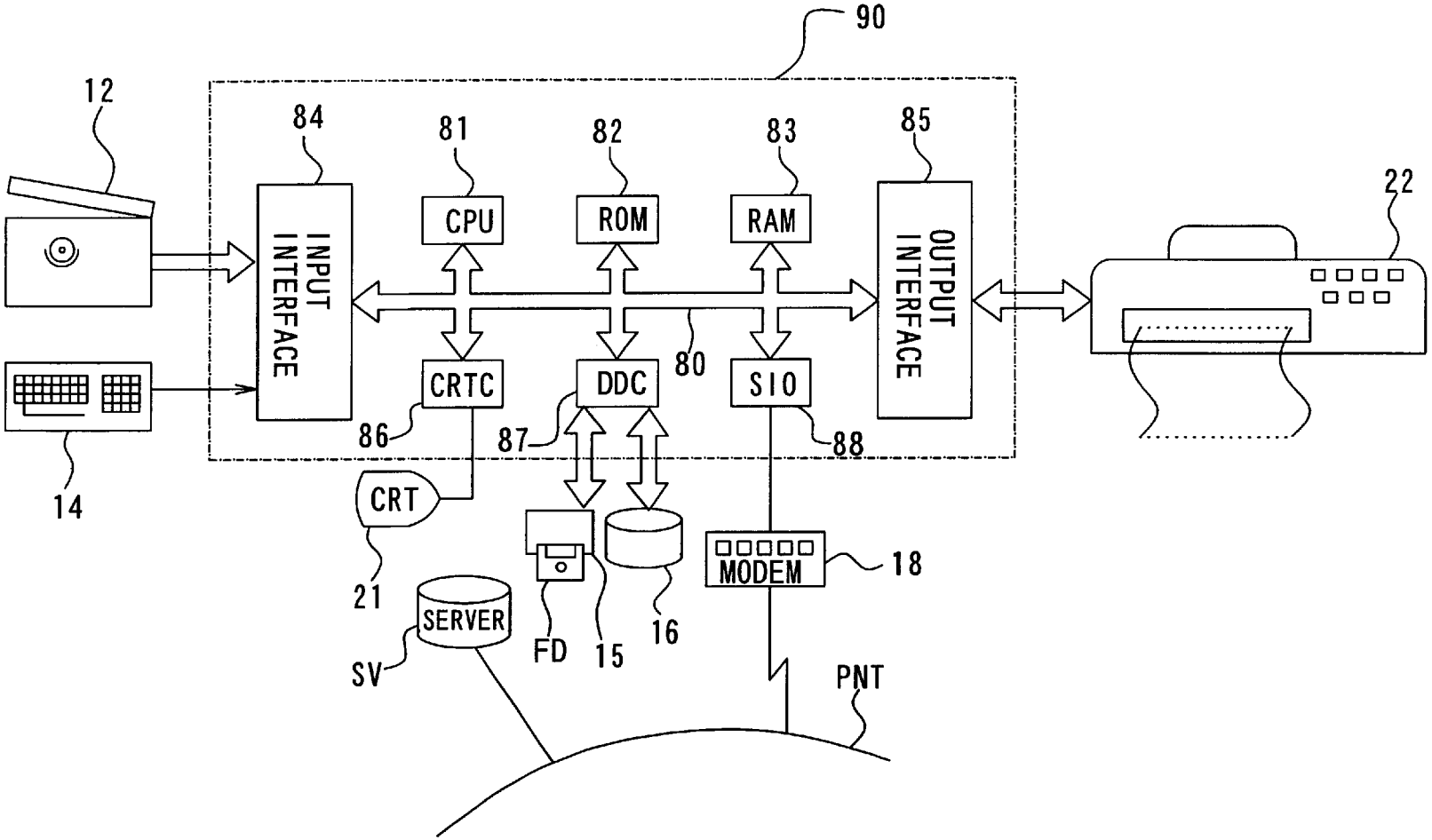
FIG. 1 is a block diagram illustrating the structure of a printing apparatus in one embodiment according to the present invention.

FIG. 1 is a block diagram illustrating the structure of a printing apparatus in one embodiment according to the present invention. The printing apparatus includes a computer 90 connected to a scanner 12 and a color printer 22. The computer 90 reads and executes predetermined programs to function, in combination with the printer 22, as the printing apparatus. The computer 90 includes a CPU 81, a ROM 82, a RAM 83, and the following constituents mutually connected via a bus 80. An input interface 84 is in charge of input of signals from the scanner 12 and a keyboard 14, whereas an output interface 85 is in charge of output of data to the printer 22. A CRTC 86 controls output of signals to a color CRT display 21. A disk controller (DDC) 87 controls transmission of data to and from a hard disk 16, a flexible disk drive 15, and a CD-ROM drive (not shown). A variety of programs loaded to the RAM 83 and executed as well as a variety of other programs provided in the form of device drivers are stored in the hard disk 16.

A serial input-output interface (SIO) 88 is also connected to the bus 80. The SIO 88 is connected to a modem 18 and further to a public telephone network PNT via the modem 18. The computer 90 is connected with an external network via the SIO 88 and the model 18 and may gain access to a specific server SV to download the programs required for the image processing into the hard disk 16. Another possible application reads the required programs from a flexible disk FD or a CD-ROM and causes the computer 90 to execute the input programs.

Figure 2:
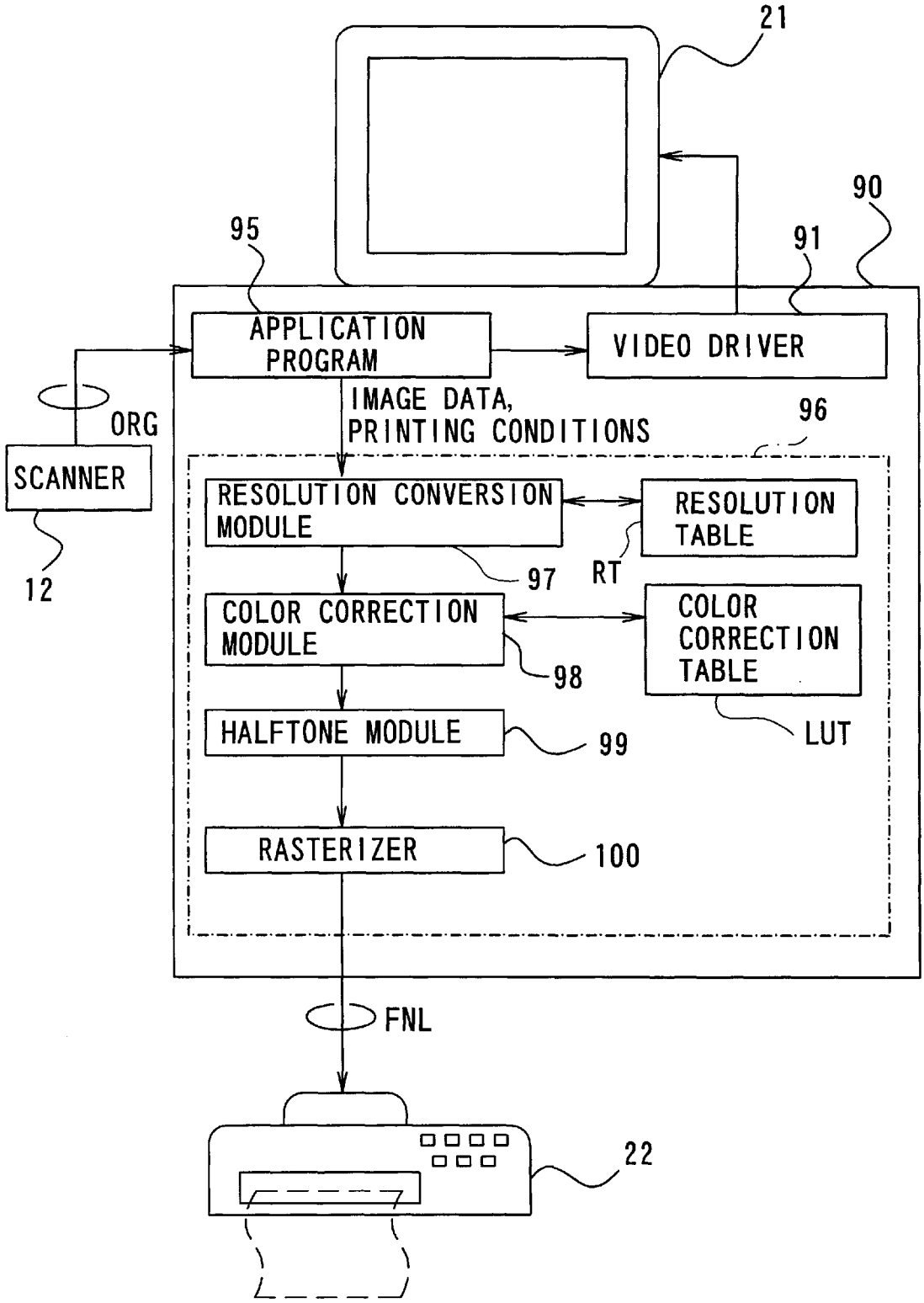
FIG. 2 is a block diagram illustrating a software configuration of the printing apparatus of the embodiment.

FIG. 2 is a block diagram illustrating a software configuration of the printing apparatus. The computer 90 executes an application program 95 under a specific operating system. A video driver 91 and a printer driver 96 are incorporated in the operating system. The scanner 12 reads a color original and outputs original color image data ORG, which represent the scanned color original and consist of tone values of three color components, red (R), green (G), and blue (B), to the application program 95. The application program 95 outputs image data, which are processed by the printer driver 96 and subsequently output as print data FNL to the color printer 22. The application program 95, which implements required image processing, such as retouching of images, receives the original color image data ORG from the scanner 12, causes the input image data to be subjected to the required image processing, and displays a resulting processed image on the CRT display 21 via the video driver 91.

When the application program 95 issues a print instruction, the printer driver 96 of the computer 90 receives the image data and printing conditions from the application program 95 and converts the input image data into signals processible by the color printer 22. The printing conditions input here includes the type of the printing medium adopted. In the example of FIG. 2, the printer driver 96 includes a resolution conversion module 97 with a resolution table RT, a color correction module 98 with a color correction table LUT, a halftone module 99, and a rasterizer 100.

The resolution conversion module 97 converts a resolution, that is, a number of pixels per unit length, of the input color image data processed by the application program 95 to a resolution corresponding to the input printing conditions. The resolution table RT stores available resolutions corresponding to the respective combinations of printing conditions. The resolution conversion module 97 refers to the resolution table RT, reads the resolution corresponding to the input printing conditions, and converts the resolution of the color image data to the read-out resolution. The image data with the converted resolution are still the pieces of information consisting of three color components R, G, and B.

The color correction module 98 refers to the color correction table LUT and converts the color components R, G, and B of the image data to color components, cyan (C), magenta (M), yellow (Y), and black (K), used in the color printer 22, with regard to each pixel. The color correction is not performed when the input printing conditions specify non-execution of color printing.

The color-corrected image data generally have a wide range of tone values, for example, 256 tones. The halftone module 99 carries out the halftone processing to enable the color printer 22 to express the tone values by dispersion of dots. The color printer 22 of this embodiment is a multi-level printer that ejects variable quantities of ink to create a plurality of variable-size dots having different areas as discussed later. The halftone module 99 specifies the on-off level of each dot in each pixel, based on the tone values of the input image data. The rasterizer 100 rearranges the processed image data to a certain sequence of data to be transferred to the printer 22 and outputs the rearranged image data as the final print data FNL. In this embodiment, the printer 22 only plays a role of creating dots based on the print data FNL and does not carry out the image processing. In accordance with another possible application, however, the printer 22 may carry out the image processing as well as the creation of dots.

Figure 3:
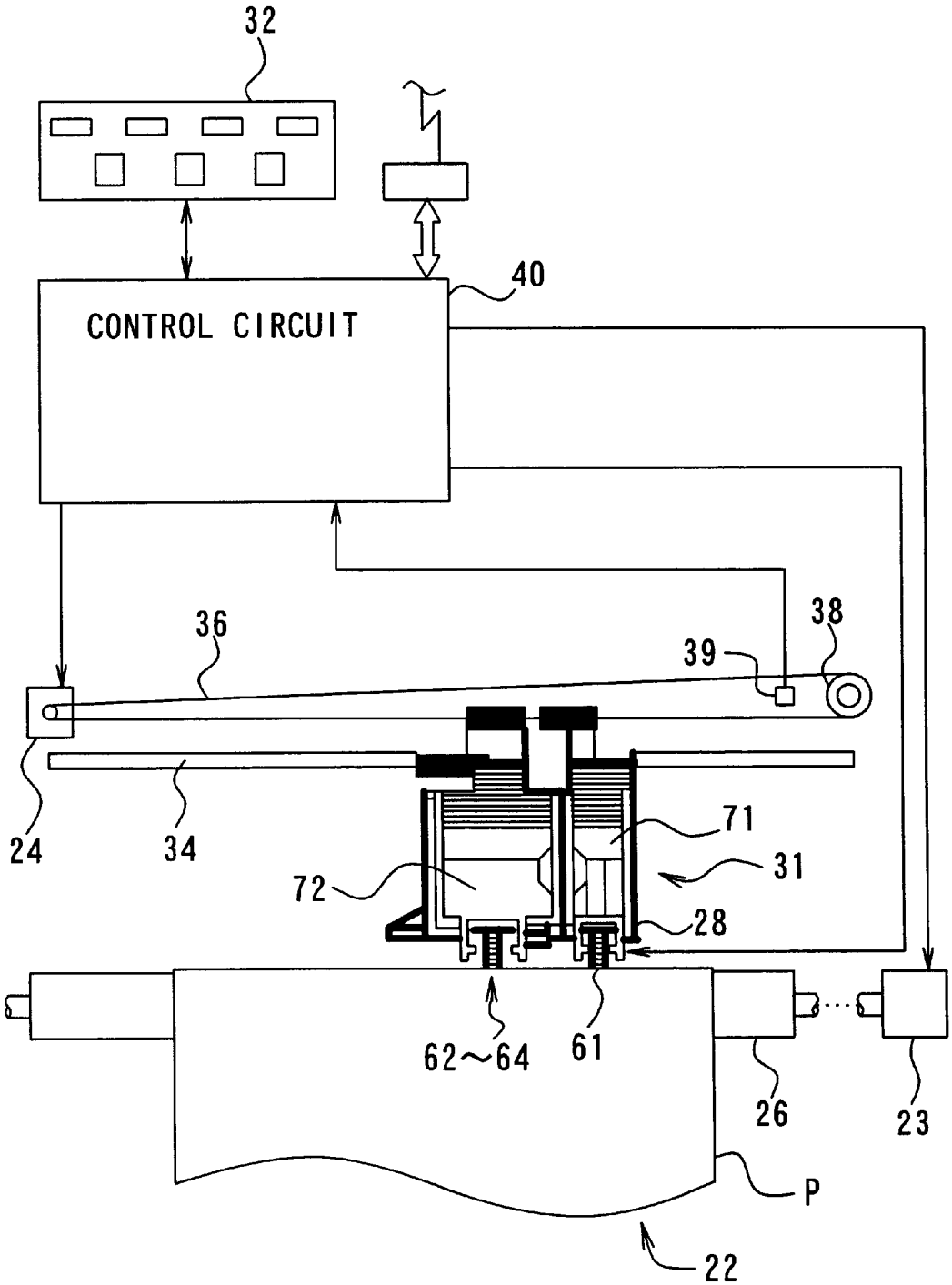
FIG. 3 schematically illustrates the structure of the color printer included in the printing apparatus of the embodiment.

The schematic structure of the printer 22 used in this embodiment is described with the drawing of FIG. 3. The printer 22 has a mechanism of feeding a sheet of printing paper P by means of a sheet feed motor 23, a mechanism of moving a carriage 31 forward and back along an axis of a platen 26 by means of a carriage motor 24, a mechanism of driving a print head 28 mounted on the carriage 31 to eject ink and create dots, and a control circuit 40 that controls transmission of signals to and from the sheet feed motor 23, the carriage motor 24, the print head 28, and a control panel 32.

The mechanism of reciprocating the carriage 31 along the axis of the platen 26 includes a sliding shaft 34 arranged in parallel with the axis of the platen 26 for slidably supporting the carriage 31, a pulley 38, an endless drive belt 36 spanned between the carriage motor 24 and the pulley 38, and a position sensor 39 that detects the position of the origin of the carriage 31.

A black ink cartridge 71 for black ink (Bk) and a color ink cartridge 72 in which three color inks, that is, cyan (C), magenta (M), and yellow (Y), are accommodated are detachably attached to the carriage 31 in the printer 22. A total of four ink ejection heads 61 through 64 are formed on the print head 28 that is disposed in the lower portion of the carriage 31. When the black ink cartridge 71 and the color ink cartridge 72 are attached downward to the carriage 31, supplies of inks are fed from the respective ink cartridges 71 and 72 to the ink ejection heads 61 through 64.

Figure 4A:
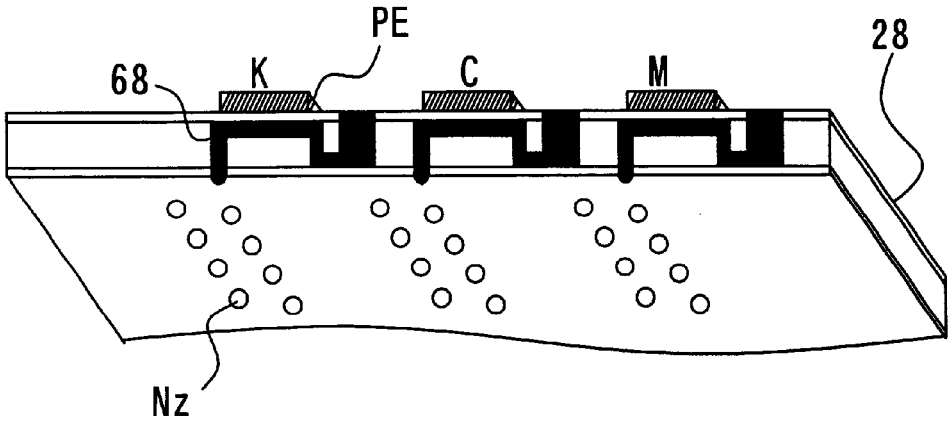
FIGS. 4A and 4B show the principle of creating dots in the color printer of the embodiment.
Figure 4B:
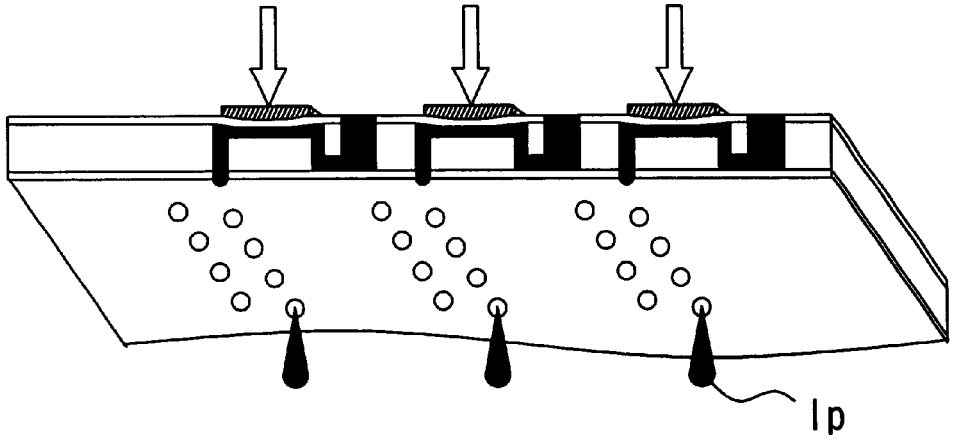

The following describes the mechanism of ejecting ink to create dots. FIGS. 4A and 4B schematically illustrates the internal structure of the print head 28. For the clarity of illustration, the elements with regard to the yellow (Y) ink are omitted from the illustration. An array of forty-eight nozzles Nz is formed in each of the ink ejection heads 61 through 64, where each nozzle Nz has a corresponding piezoelectric element PE arranged to be in contact with an ink conduit 68, through which the supply of ink is led to the nozzle Nz as shown in FIG. 4A. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric elements PE for a predetermined time period, the piezoelectric element PE is expanded for the predetermined time period to deform one side wall of the ink conduit 68 as shown in FIG. 4B. The volume of the ink conduit 68 is reduced according to the expansion of the piezoelectric element PE. A certain amount of ink corresponding to the reduction is ejected as an ink particle Ip from the nozzle Nz at a high speed. The ink particle Ip soaks into the printing paper P set on the platen 36 and creates a dot on the printing paper P.

Figure 5:
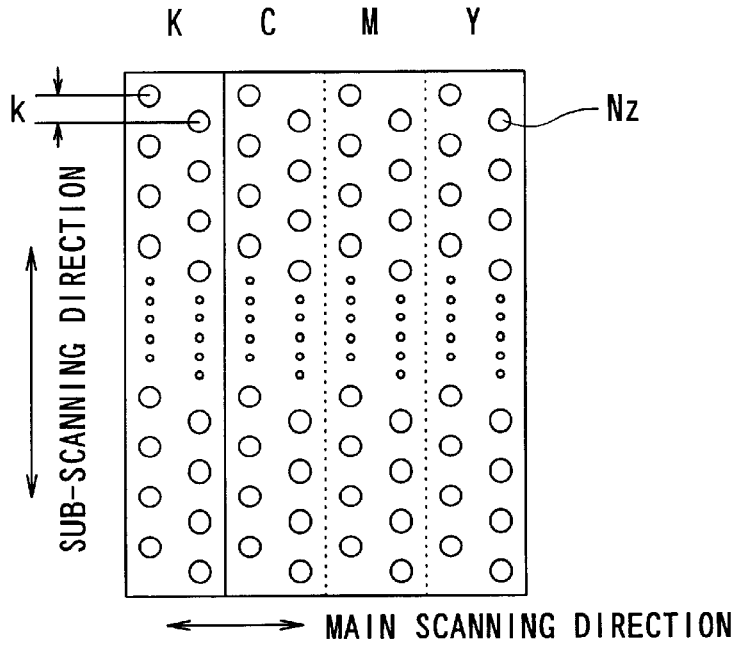
FIG. 5 shows an arrangement of nozzle arrays in the color printer of the embodiment.

FIG. 5 shows an arrangement of the ink jet nozzles Nz in each of the ink ejection heads 61 through 64. The arrangement of nozzles shown in FIG. 5 includes four nozzle arrays, wherein each nozzle array ejects ink of each color and includes forty-eight nozzles Nz arranged in zigzag at a fixed nozzle pitch k. The positions of the nozzles in the sub-scanning direction are identical in the respective nozzle arrays. The zigzag arrangement allows a small value to be set to the nozzle pitch k in the manufacturing process. The forty-eight nozzles Nz included in each nozzle array may, however, be arranged in alignment, instead of in zigzag.

Figure 6:
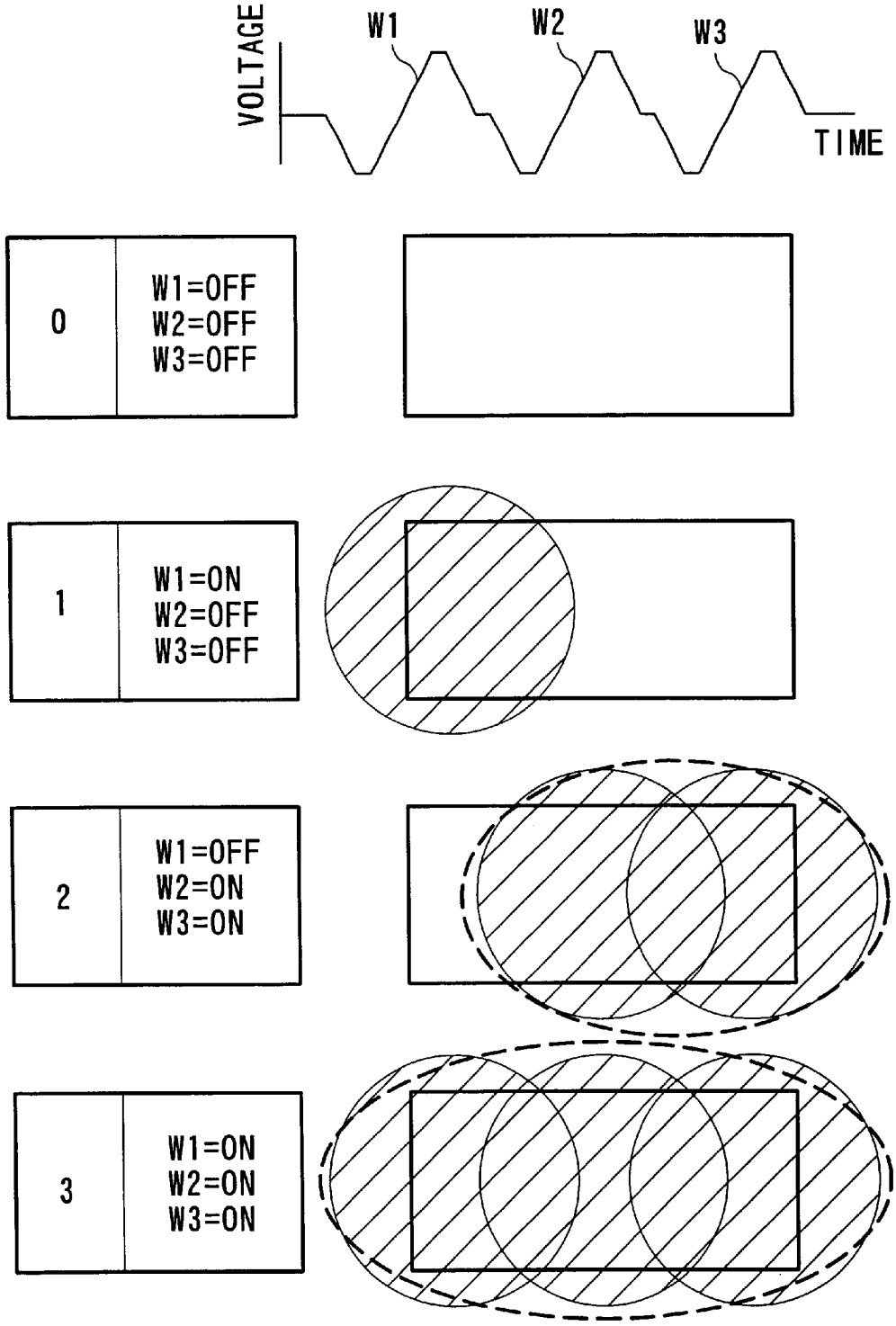
FIG. 6 shows a variety of dots possibly created by the color printer of the embodiment.

The printer 22 of this embodiment creates three variable-size dots having different areas by varying the weight of ink ejected in each pixel. FIG. 6 shows the three variable-size dots possibly created in this embodiment. The printer 22 of this embodiment uses three driving waveforms W1, W2, and W3 to create the three variable-size dots in the respective pixels. Each driving waveform first falls from a reference voltage to a lower level, then rises to a higher level than the reference voltage, and finally returns to the reference voltage as shown in FIG. 6. The driving waveforms W1, W2, and W3 are identical. In the printer 22 of this embodiment, the period allocated to each pixel enables output of the three driving waveforms, with the movement of the carriage 31.

The control circuit 40 of the printer 22 selectively sets the on-off conditions of the driving waveforms W1, W2, and W3 according to the size of the dot to be created in each pixel. For example, in the case where the print data FNL is equal to 0, which represents creation of no dots, all the driving waveforms W1, W2, and W3 are turned off. In this case, no dot is created as shown in FIG. 6. In the drawing of FIG. 6, each rectangle PC represents a pixel, the width of the drawing corresponds to the main scanning direction, and the length of the drawing corresponds to the sub-scanning direction.

In the case where the print data FNL is equal to 1, which represents creation of a minimum-area dot (hereinafter referred to as the small dot), only the driving waveform W1 is turned on. In this case, the minimum-area dot is created by one ink droplet ejected from the nozzle as shown in FIG. 6. The hatched circle represents the dot created. In the case where the print data FNL is equal to 2, which represents creation of an intermediate-area dot (hereinafter referred to as the medium dot), the driving waveforms W2 and W3 are turned on. In this case, the intermediate-area dot is created by two ink droplets successively ejected from the nozzle as shown in FIG. 6. The two ink droplets successively ejected join to one before being dried, and form a flat dot shown by the dotted line.

In the case where the print data FNL is equal to 3, which represents creation of a maximum area dot (hereinafter referred to as the large dot), all the driving waveforms W1, W2, and W3 are turned on. In this case, the maximum area dot is created by three ink droplets successively ejected from the nozzle as shown in FIG. 6. The three ink droplets successively ejected joint to one before being dried, and form a flat dot shown by the dotted line. In the printer 22 of the embodiment, the resolution, that is, the size of the pixel, is set to allow the maximum area dot to sufficiently cover the pixel PC. The details of the setting will be discussed later. As shown in FIG. 6, the dimension of the pixel in the sub-scanning direction is set shorter than the dimension of the pixel in the main scanning direction, according to the shape of the dot possibly created therein.

In this embodiment, the driving waveforms W1, W2, and W3 are identical to eject a fixed quantity of ink. In accordance with another possible application, different driving waveforms are used to eject different quantities of ink. For example, the driving waveforms W1, W2, and W3 are set to form the small dot, the medium dot, and the large dot, respectively. The combination of these different driving waveforms enables expression of a greater number of tone values. Compared with a printer that prints an image at a high resolution using only one fixed-size dot corresponding to the medium dot of this embodiment, the arrangement of this embodiment using the small dot enables an image of excellent granularity to be printed even in a print mode of relatively low resolution.

Figure 7:
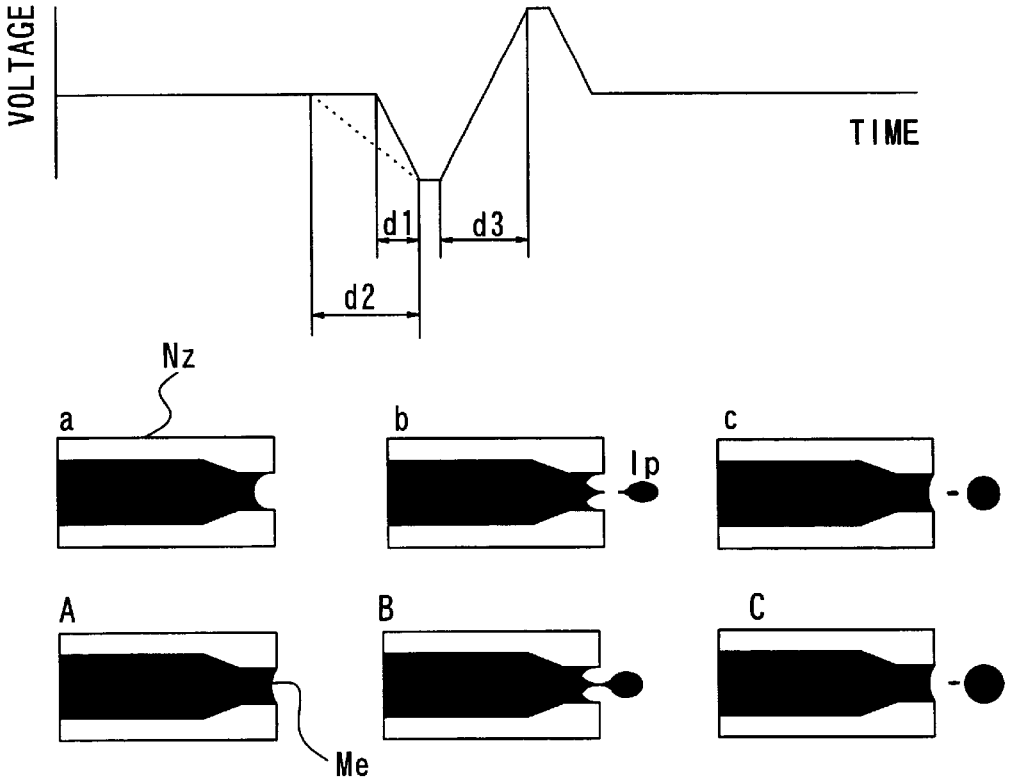
FIG. 7 shows the principle of varying the quantity of ink ejected from the nozzle in the color printer of the embodiment.

The printer 22 of this embodiment uses the plural driving waveforms to create variable-area dots in the respective pixels as shown in FIG. 6. Another applicable technique changes the driving waveform itself to vary the quantity of ink ejected from the nozzle. The following describes the principle of such ink ejection. FIG. 7 shows the relationship between the driving waveform of the nozzle Nz and the size of the ink particle Ip ejected from the nozzle Nz. The driving waveform shown by the dotted line in FIG. 7 is used to create standard-size dots. Application of a voltage lower than a reference voltage to the piezoelectric element PE in a division d2 deforms the piezoelectric element PE in the direction of increasing the cross section of the ink conduit 68, contrary to the case discussed previously with the drawings of FIGS. 4A and 4B. Since there is a limit in ink supply speed to the nozzle, the quantity of ink supply has an insufficiency relative to the expansion of the ink conduit 68. As shown in a state A of FIG. 7, an ink interface Me is thus slightly concaved inward the nozzle Nz. When the driving waveform shown by the solid line in FIG. 7 is used to abruptly lower the voltage in a division d1, on the other hand, the quantity of ink supply has a further insufficiency and the ink interface Me is more significantly concaved inward the nozzle Nz as shown in a state 'a' of FIG. 7, compared with the state A.

Subsequent application of a high voltage to the piezoelectric element PE in a division d3 reduces the sectional area of the ink conduit 68 and compresses the ink in the ink conduit 68, thereby causing an ink droplet to be ejected from the ink nozzle Nz as discussed previously with FIGS. 4A and 4B. The size of the ink droplet depends upon the degree of insufficiency of the ink supply quantity. As shown in states B and C of FIG. 7, a large ink droplet is ejected when the ink interface Me is only slightly concaved inward (state A). As shown in states 'b' and 'c' of FIG. 7, on the other hand, a small ink droplet is ejected when the ink interface Me is significantly concaved inward (state 'a'). The size of the dot to be created can thus be varied by changing the rate of decrease in driving voltage (see the divisions d1 and d2). The application of the varied driving waveform to the example of FIG. 6 increases the area of the dot possibly created in each pixel. The number of driving waveforms corresponding to one pixel is not restricted to three, but may be varied according to the requirements.

Figure 8:
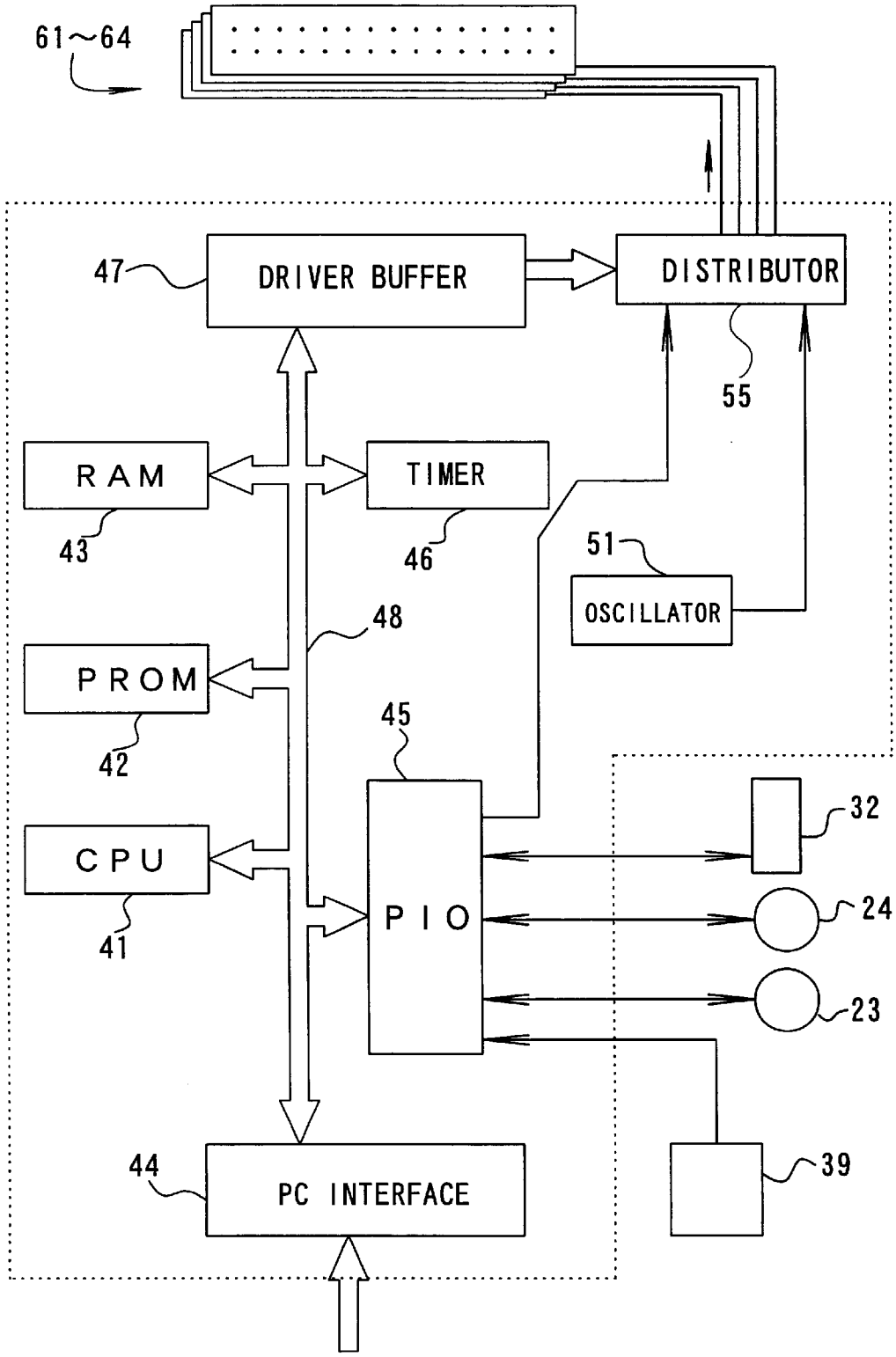
FIG. 8 is a block diagram illustrating the internal structure of a control circuit included in the color printer of the embodiment.

The following describes the internal structure of the control circuit 40 in the printer 22. FIG. 8 illustrates the internal structure of the control circuit 40. The control circuit 40 includes a CPU 41, a PROM 42, a RAM 43, a PC interface 44 that transmits data to and from the computer 90, a peripheral equipment input-output unit (PIO) 45 that transmits signals to and from the peripheral equipment including the carriage motor 24 and the control panel 32, a timer 46 that counts the time, and a drive buffer 47 that outputs dot on-off signals to the ink ejection heads 61 through 64. These elements and circuits are mutually connected via a bus 48. The control circuit 40 further includes an oscillator 51 that outputs driving waveforms at selected frequencies (see FIG. 6) and a distributor 55 that distributes the outputs from the oscillator 51 to the ink ejection heads 61 through 64 at selected timings.

The control circuit 40 receives the print data FNL processed by the computer 90, temporarily stores the print data FNL in the RAM 43, and outputs the print data FNL to the drive buffer 47 at a preset timing. The driver buffer 47 determines the on-off conditions of the respective driving waveforms W1, W2, and W3 in the respective pixels according to the print data FNL and outputs the results of the determination to the distributor 55. The distributor 55 outputs the driving waveforms W1, W2, and W3 to the respective nozzles based on the input results, in order to create the variable-size dots shown in FIG. 6.

The ink ejection heads 61 through 64 are arranged in the moving direction of the carriage 31 as shown in FIG. 5, so that the respective nozzle arrays reach a specific position on the printing paper P at different timings. Although not being illustrated, a delay circuit is mounted on the output side of the distributor 55. The driving waveform is output at a specific timing that aligns the positions of dots in the main scanning direction formed by the respective nozzles according to the positional difference between the corresponding nozzles included in the ink ejection heads 61 through 64 and the scanning speed of the carriage 31. The CPU 41 accordingly outputs the dot on-off signals at required timings via the drive buffer 47 to create the dots of the respective colors by taking into account the positional difference between the corresponding nozzles included in the ink ejection heads 61 through 64. The CPU 41 also controls the output of the dot on-off signals by considering the two-line arrangement of each nozzle array on each of the ink ejection heads 61 through 64 as shown in FIG. 5.

In the printer 22 of the embodiment having the hardware structure discussed above, while the sheet feed motor 23 feeds the sheet of printing paper P (hereinafter referred to as the sub-scan), the carriage motor 24 drives and reciprocates the carriage 31 (hereinafter referred to as the main scan), simultaneously with actuation of the piezoelectric elements PE on the respective ink ejection heads 61 through 66 of the print head 28. The printer 22 accordingly sprays the respective color inks to create dots and thereby forms a multi-color image on the printing paper P.

In this embodiment, the printer 22 has the head that uses the piezoelectric elements PE to eject ink as discussed previously. The printer may, however, adopt another technique for ejecting ink. One alternative structure of the printer supplies electricity to a heater installed in an ink conduit and utilizes the bubbles generated in the ink conduit to eject ink.

(2) Control of Dot Creation

Figure 9:
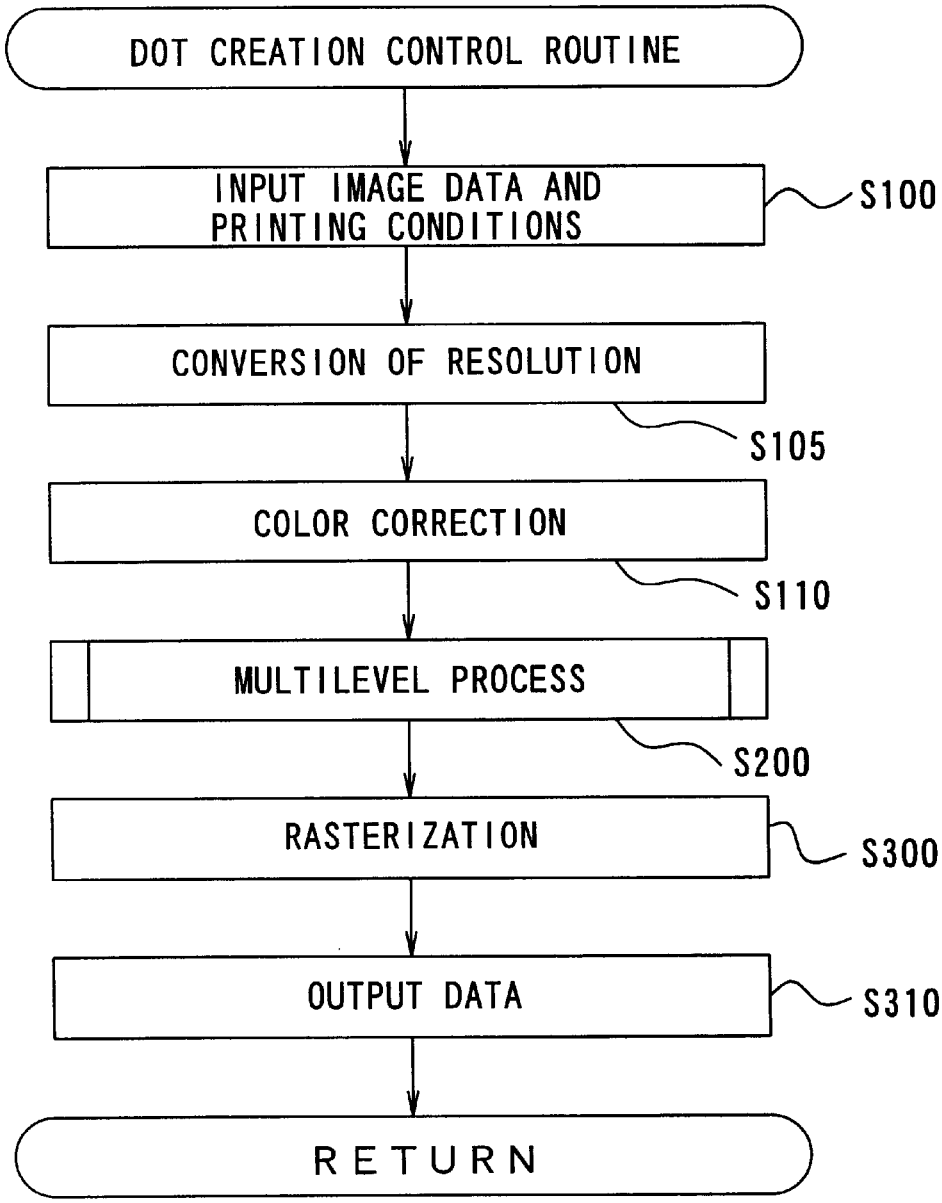
FIG. 9 is a flowchart showing a dot creation control routine executed in the printing apparatus of the embodiment.

The following describes a control procedure of dot creation executed in this embodiment, with referring to the flowchart of FIG. 9. The dot creation control routine of FIG. 9 is executed by the CPU 81 of the computer 90.

When the program enters the routine, the CPU 81 first inputs image data and printing conditions at step S100. The image data, which are fed from the application program 95 shown in FIG. 2, are 256-tone data that may take a tone value in the range of 0 to 255 for each of the colors R, G, and B with regard to each pixel included in the image. The resolution of the image data depends upon the resolution of the original image data ORG and the like. The printing conditions include, for example, the type of the printing paper, the specification of color or non-color printing, and the specification of the overlap or non-overlap printing.

Figure 10A:
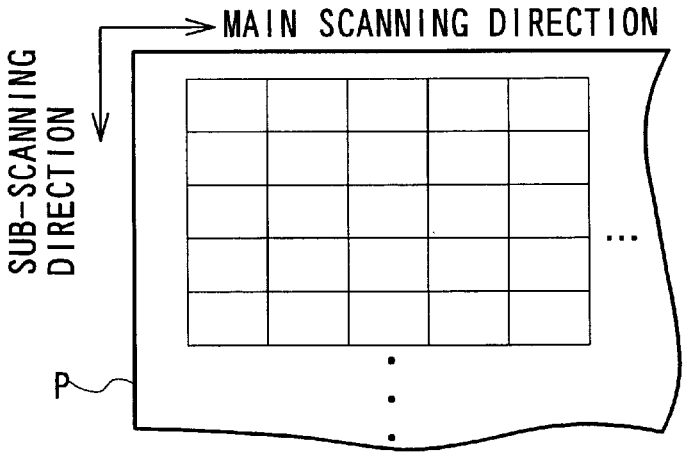
FIGS. 10A through 10C show examples of the printing resolution provided in the color printer of the embodiment.
Figure 10B:
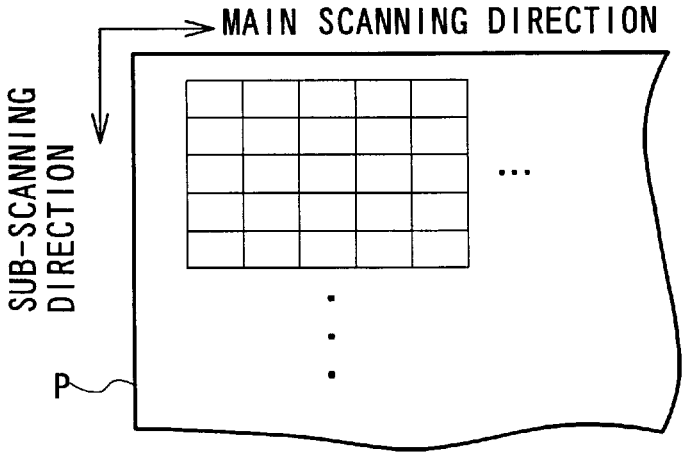

The CPU 81 subsequently converts the resolution of the input image data to the printing resolution adopted in the printer 22 at step S105. In this embodiment, various printing resolutions are set in advance. FIGS. 1OA through 10C show examples of the printing resolution provided in this embodiment, where each square represents a pixel. The example of FIG. 10A shows a standard resolution, wherein pixels having the longitudinal sides in the main scanning direction are arrayed in a two-dimensional manner. Namely different values are set to the resolution in the main scanning direction and to the resolution in the sub-scanning direction. In this embodiment, the standard resolution is set equal to 360 dpi (dot per inch) in the main scanning direction and equal to 720 dpi in the sub-scanning direction. The example of FIG. 10B shows a higher resolution than the standard. The size of each pixel in the higher resolution is smaller than the size of pixel in the standard resolution shown in FIG. 10A. In this embodiment, the higher resolution is double the standard resolution both in the main scanning direction and in the sub-scanning direction. When printing paper that does not readily blot is set as the printing condition, the higher resolution is selected.

Figure 10C:
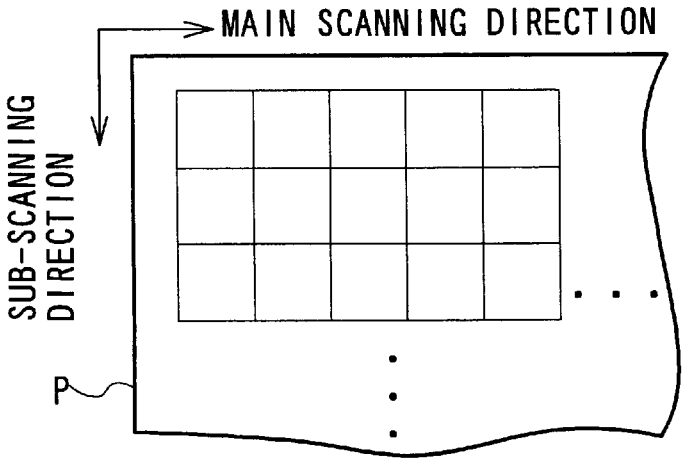

As shown in FIG. 10C, another available example adopts the same resolution both in the main scanning direction and in the sub-scanning direction. The identical resolution is selected when the printing mode with only a single-size dot possibly created in the respective pixels is specified as the printing condition. In this embodiment, the identical resolution is set equal to 360 dpi both in the main scanning direction and in the sub-scanning direction. The printer 22 of this embodiment carries out the printing operation at a desired resolution determined according to the printing condition. The CPU 81 refers to the resolution table RT, which is provided in advance, to set the adequate resolution, which will be discussed later in detail.

A variety of techniques are applicable to the conversion of the resolution. According to the technique applied in this embodiment for the conversion of the resolution, in the case where the resolution of the input image data is lower than the printing resolution, linear interpolation is carried out to generate a new piece of data between the adjoining pieces of the original image data ORG and implement the conversion of the resolution. In the case where the resolution of the input image data is higher than the printing resolution, on the contrary, the conversion of the resolution is implemented by skipping some pieces of data at a predetermined rate. When the resolution of the input image data coincides with the printing resolution, no such processing is required naturally.

The CPU 81 subsequently carries out color conversion at step S110. The color conversion converts the image data consisting of the tone values of R, G, and B into data consisting of the tone values of C, M, Y, and K used in the color printer 22. The color conversion table LUT (see FIG. 2) is used for the color conversion. The color conversion table LUT stores combinations of C, M, Y, and K that cause the color printer 22 to express the colors defined by the respective combinations of R, G, and B. A variety of known techniques may be adopted in the color conversion process with the color conversion table LUT. For example, the interpolation technique may be adopted in the color conversion process. The processing of step S110 converts the image data into the 256-tone data of the respective colors, C, M, Y, and K.

Figure 11:
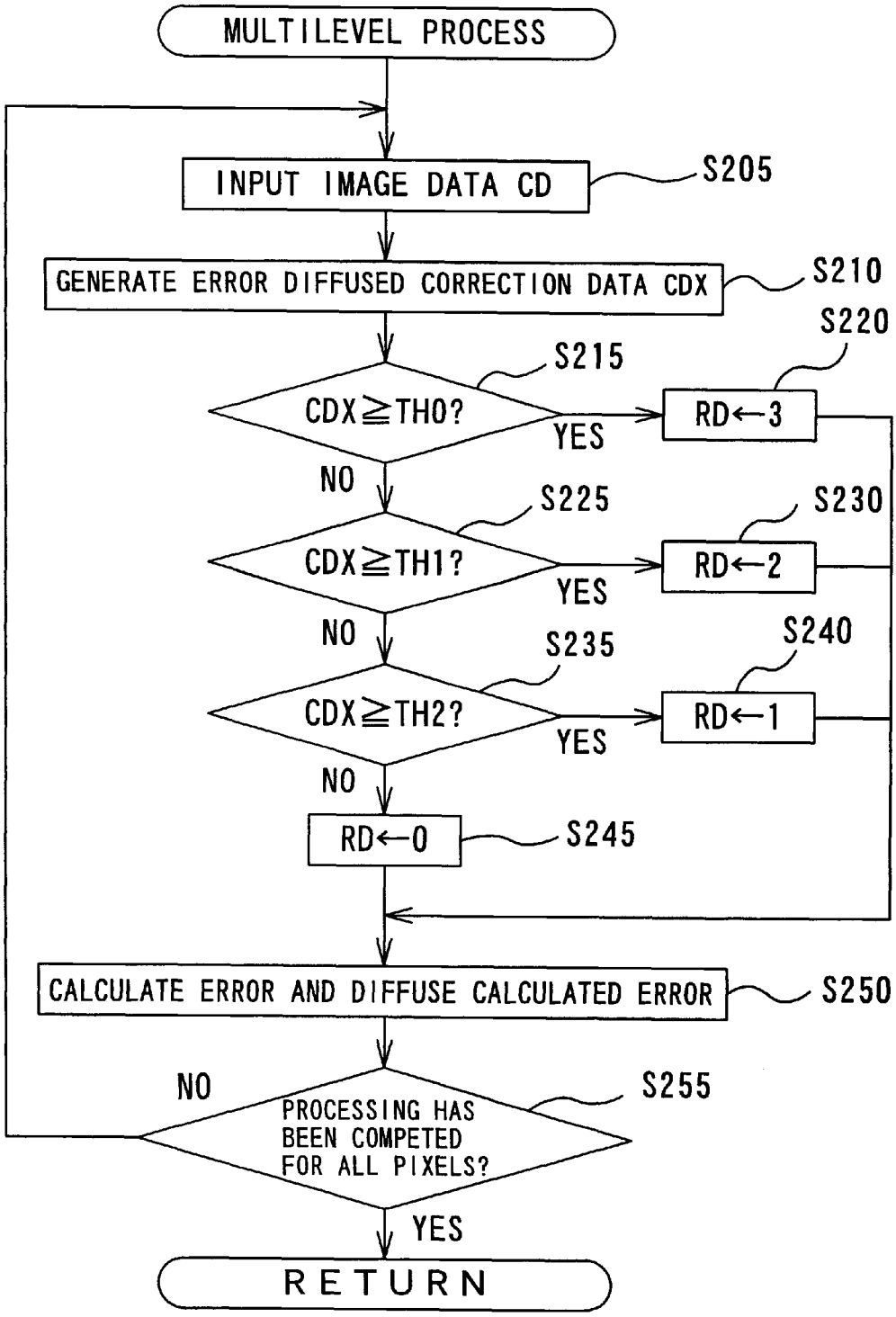
FIG. 11 is a flowchart showing the details of the multilevel process executed at step S200 in the flowchart of FIG. 9.

The CPU 81 then causes the color-corrected image data to be subjected to a multilevel process at step S200. The multilevel process converts the tone values of the original image data (256 tones in this embodiment) into the tone values expressible in each pixel by the printer 22. As shown in FIG. 6, there are four possible levels or tone expressible by the printer 22 in this embodiment; that is, 'creation of no dots', 'creation of the small dot', 'creation of the medium dot', and 'creation of the large dot'. The number of possible levels is not restricted to four, but may be varied arbitrarily according to the number of variable-size dots possibly created by the printer 22. The details of the multilevel process executed in this embodiment are described with reference to the flowchart of FIG. 11.

The error diffusion method is applied for the multilevel process in this embodiment. When the program starts the multilevel process routine of FIG. 11, the CPU 81 first inputs image data CD with regard to a pixel of interest at step S205. The image data CD input here are color-converted, 256-tone data regarding the respective colors C, M, Y, and K.

Figure 12A:
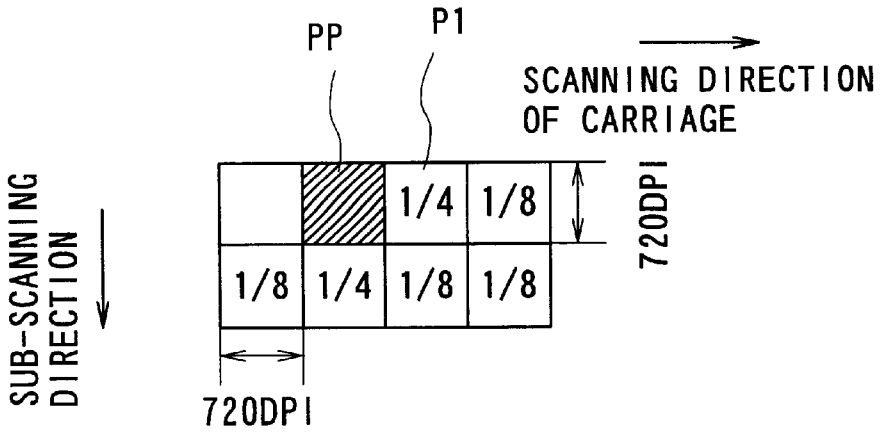
FIGS. 12A through 12C show examples of error diffusion, in which an error generated in a pixel of interest PP just processed is distributed to peripheral pixels with certain weights.
Figure 12B:
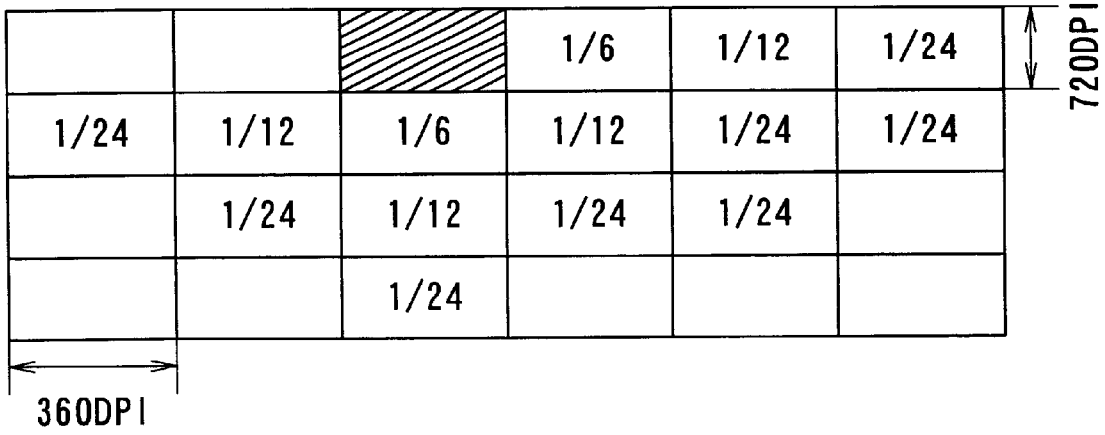
Figure 12C:
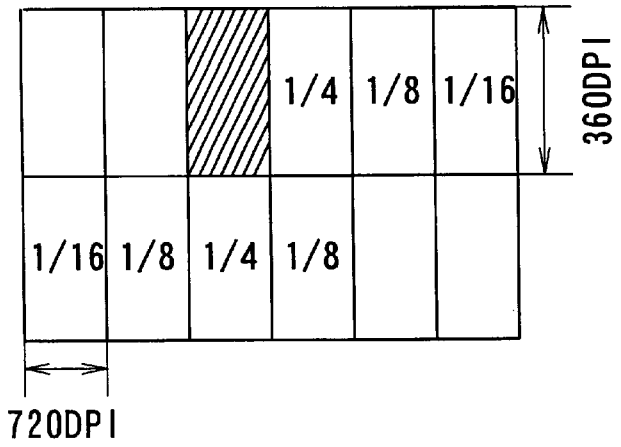

The CPU 81 generates diffused error correction data CDX from the input image data CD in the pixel of interest at step S210. The error diffusion process distributes a density error generated in each processed pixel to peripheral pixels adjoining to the processed pixel with preset weights. The processing of step S210 corrects the input image data CD with regard to the pixel of interest, which is currently being processed, with the sum of the errors diffused previously from the processed pixels. FIGS. 12A through 12C show examples of error diffusion, in which an error generated in a pixel of interest PP just processed is distributed to peripheral pixels with certain weights. The density error generated in the pixel of interest PP is distributed to several subsequent pixels in the scanning direction of the carriage 31 and several adjoining pixels in the feeding direction of the printing paper P.

In this embodiment, the printing operation may be carried out at various resolutions as described above. The allocation of the error is specified according to the resolution, in order to attain the high-quality printing in this embodiment. FIG. 12A shows the area of error diffusion in the case where the identical resolution is set in the main scanning direction and in the sub-scanning direction, that is, at the time of printing with the resolution shown in FIG. 10C. FIG. 12B shows the area of error diffusion in the case where the resolution in the main scanning direction is lower than the resolution in the sub-scanning direction, that is, at the time of printing with the resolution shown in FIG. 10A.

If the error diffusion is carried out with the preset weights shown in FIG. 12A in the case where the resolution in the main scanning direction is lower than the resolution in the sub-scanning direction, the area of the error diffusion extends in the main scanning direction. This is because each pixel has the longitudinal side in the main scanning direction. Namely the error is diffused in a narrower area in the sub-scanning direction than in the main scanning direction. This results in a greater variation in density in the sub-scanning direction than in the main scanning direction and undesirably lowers the printing quality. In the technique of this embodiment, in the case where the resolution in the main scanning direction is lower than the resolution in the sub-scanning direction, the area of error diffusion is extended in the sub-scanning direction as shown in FIG. 12B. This ensures the error diffusion without any extreme difference in area between the main scanning direction and the sub-scanning direction. Although not being illustrated in the examples of FIG. 10, in the case where the resolution in the main scanning direction is higher than the resolution in the sub-scanning direction, on the contrary, it is desirable to extend the area of error diffusion in the main scanning direction as shown in FIG. 12C.

The diffused error correction data CDX thus generated for the pixel of interest is compared with a predetermined first threshold value TH0 at step S215. When the correction data CDX is not less than the predetermined first threshold value TH0, the program determines that a large dot is to be created in the pixel of interest and sets a value '3' representing 'creation of the large dot' to a resulting value RD of the multilevel process at step S220. The first threshold value TH0 is used as the criterion for determining the on-off level of the large dot. Any arbitrary value may be set to the first threshold value TH0, but the mean of a density evaluation value of the large dot and a density evaluation value of the medium dot is set to the first threshold value TH0 in this embodiment. The density evaluation value represents a density expressible by each dot corresponding to the tone value of the image data.

When the correction data CDX is less than the predetermined first threshold value TH0, on the other hand, the correction data CDX is subsequently compared with a predetermined second threshold value TH1 at step S225. In the case where the correction data CDX is not less than the predetermined second threshold value TH1, the program determines that a medium dot is to be created in the pixel of interest and sets a value '2' representing 'creation of the medium dot' to the resulting value RD of the multilevel process at step S230. Any arbitrary value may also be set to the second threshold value TH1, but the mean of the density evaluation value of the medium dot and a density evaluation value of the small dot is set to the second threshold value TH1 in this embodiment.

When the correction data CDX is less than the predetermined second threshold value TH1, on the other hand, the correction data CDX is subsequently compared with a predetermined third threshold value TH2 at step S235. In the case where the correction data CDX is not less than the predetermined third threshold value TH2, the program determines that a small dot is to be created in the pixel of interest and sets a value '1' representing 'creation of the small dot' to the resulting value RD of the multilevel process at step S240. Any arbitrary value may also be set to the third threshold value TH2, but half the density evaluation value of the small dot is set to the third threshold value TH2 in this embodiment.

When the correction data CDX is less than the predetermined third threshold value TH2, the program determines that no dot is to be created in the pixel of interest and sets a value '0' representing 'creation of no dots' to the resulting value RD of the multilevel process at step S245. This procedure allocates one of the four levels or tones, that is, 'creation of no dots', 'creation of the small dot', 'creation of the medium dot', and 'creation of the large dot', to each pixel. The above processing with a greater number of threshold values may be carried out when the greater-level processing is required with an increase in number of variable-size dots possibly created in the respective pixels.

The CPU 81 then calculates an error Err generated in the pixel of interest as a result of the multilevel process and diffuses the error Err to the peripheral pixels at step S250. The error Err is obtained by subtracting the tone value of the original image data from the density evaluation value expressed by each dot after the multi-level process. By way of example, it is assumed that a certain pixel has a tone value '255' in the original image data. The density evaluation value in the case of creation of the large dot corresponds to the tone value '255'. The density evaluation value in the case of creation of the medium dot corresponds to the tone value '128'. The density evaluation value in the case of creation of no dots corresponds to the tone value '0'. When the result of the multilevel process is 'creation of the large dot', the tone value '255' of the original image data coincides with the density evaluation value '255' expressible by the large dot, so that the error Err is equal to 0. When the result of the multilevel process is 'creation of the medium dot', on the other hand, the error Err is equal to 128–255=−127. When the result of the multilevel process is 'creation of no dots', the error Err is equal to −255.

The calculated error Err is diffused to the peripheral pixels with the preset weights, for example, as shown in FIG. 12A. By way of example, when the pixel of interest PP has the calculated error Err=4, a tone value '1', which is ¼ of the error, is allocated as a division of the error to an adjacent pixel P1. The error is diffused with the preset weights shown in FIG. 12A to the other peripheral pixels. The diffused error correction data CDX is obtained by making the sum of the diffused errors reflect on the input image data CD at step S210. The CPU 81 repeats the processing of steps S205 through S250 until the processing has been completed for all the pixels at step S255. This procedure allocates one of the values '0' through '3' to the resulting value RD in each pixel. When the processing has been completed for all the pixels, the program exits from the multilevel process routine of FIG. 11 and returns to the dot creation control routine of FIG. 9.

A variety of other techniques are applicable to the multilevel process. For example, the dither method known in the art may be adopted, instead of the error diffusion method. In another example, the error diffusion process shown in the flowchart of FIG. 11 may be modified according to the requirements. Still another example applies the dither method for the multilevel process regarding part of the small dot, the medium dot, and the large dot and the error diffusion method for the multilevel process regarding the other dots.

Referring back to the flowchart of FIG. 9, the CPU 81 carries out rasterization at step S300. The rasterization rearranges the data corresponding to each raster line to a certain sequence of data to be transferred to the print head 28 of the color printer 22. The printer 22 records raster lines in a variety of modes. The simplest recording mode forms all the dots included in each raster line by one pass of the main scan. In this case, the data of one raster line are output in the sequence of processing to the print head 28. The overlap recording mode forms, for example, alternate dots included in each raster line by a first pass of the main scan and forms the residual dots in the raster line by a second pass of the main scan. Namely each raster line is formed by two passes of the main scan. In this case, the data transferred to the print head 28 should be arranged by alternately picking up the dots included in each raster line. The processing of step S300 rearranges the data to be transferred to the print head 28 according to the recording mode adopted in the printer 22. The rasterization is thus carried out according to the recording mode specified by the printing condition input at step S100. After the generation of the printable data by the printer 22, the CPU 81 transfers the printable data to the printer 22 at step S310. The printer 22 receives the transferred printable data, and creates dots in the respective pixels based on the transferred data, thereby printing an image.

Figure 13:
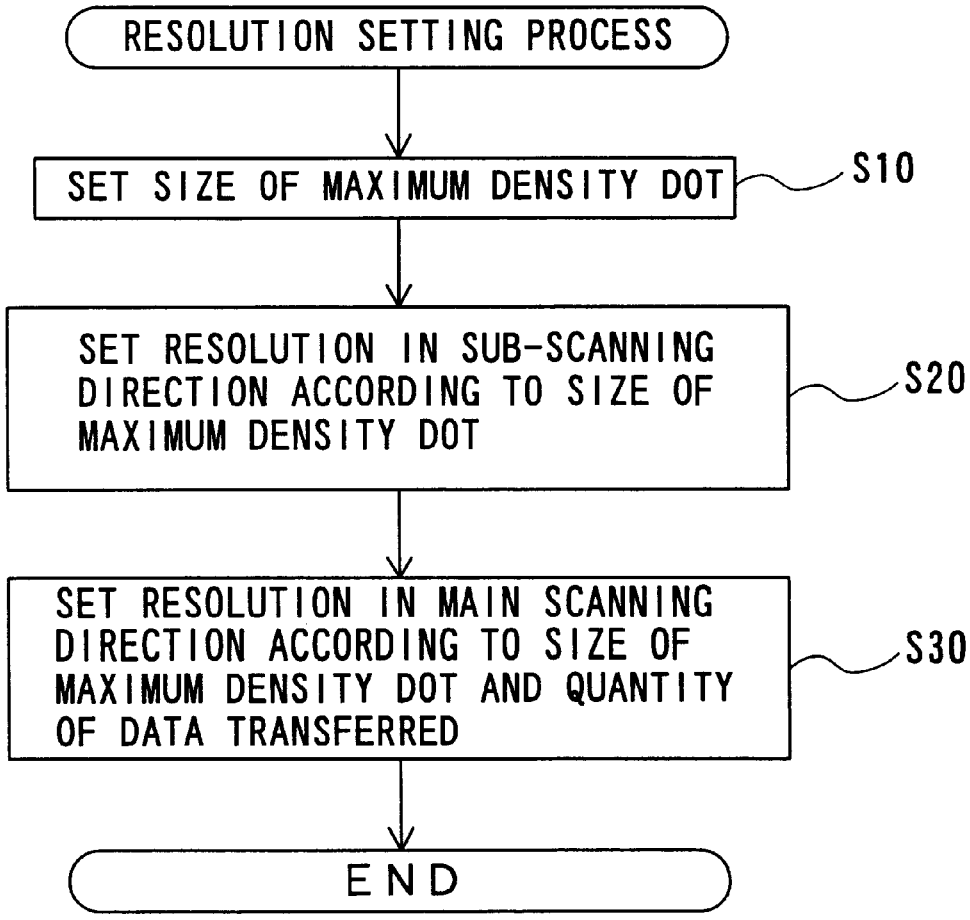
FIG. 13 is a flowchart showing a resolution setting process executed in the printing apparatus of the embodiment.

The following describes the detailed procedure of setting the printing resolution in the printer 22 of the embodiment. FIG. 13 is a flowchart showing a resolution setting process, which is carried out in the design process of the printer 22, that is, before the manufacture process of the printer 22. The process first sets the size of the maximum density dot at step S10. The maximum density dot represents the dot having a maximum quantity of ink or a maximum area. An arbitrary number of variable-size dots may be created by changing the number of driving waveforms used for creating the dot in each pixel in the printer 22. The processing of step S10 selects the maximum density dot among the variable-size dots possibly created in the respective pixels. The selection is carried out according to a variety of criteria. For the richer tone expression, it is preferable that the larger-size dot is selected as the maximum density dot. For the improved granularity of the image, on the other hand, the smaller-size dot is preferable. The maximum density dot is accordingly selected by taking into account such contradictory effects on the picture quality of the resulting printed image. In this embodiment, the large dot shown in FIG. 6 is selected as the maximum density dot.

Figures 14, 15:
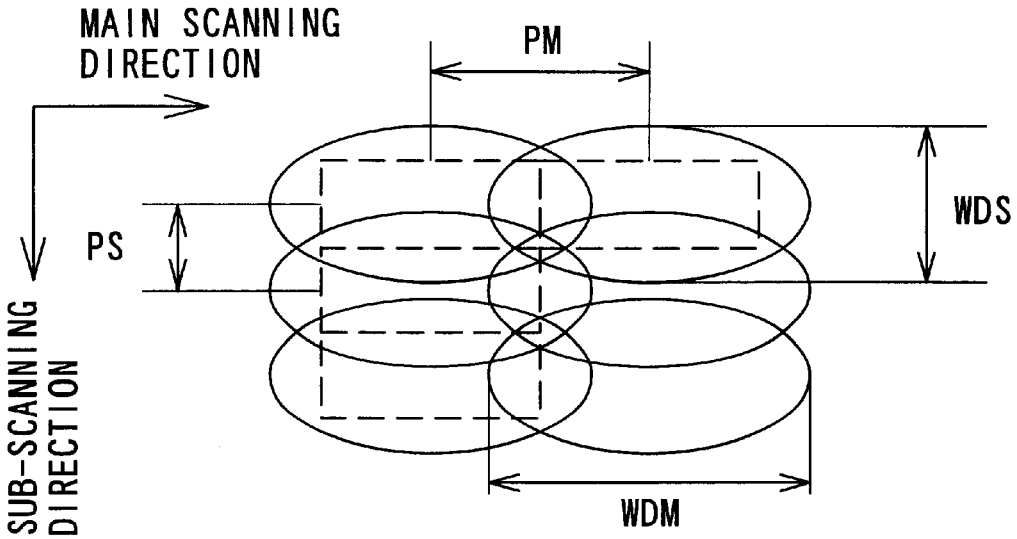
FIG. 14 shows the relationship between the dot shape and the resolution.
FIG. 15 shows the relationship between the resolution and the printing speed.
Figure 16:
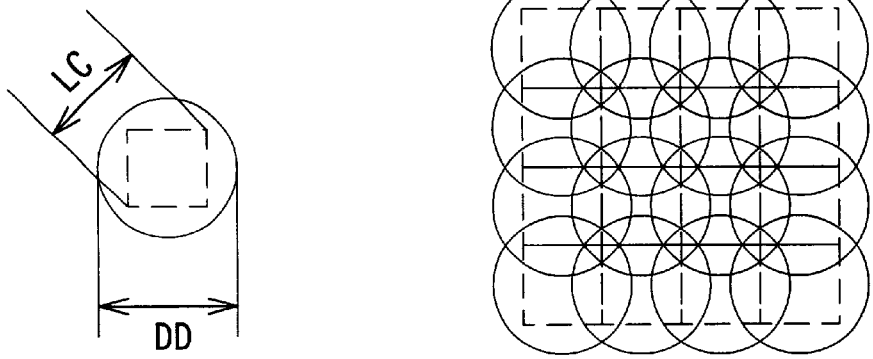
Fig. 16 PRIOR ART
FIG. 16 shows a prior art method of setting the resolution.
Figure 17:
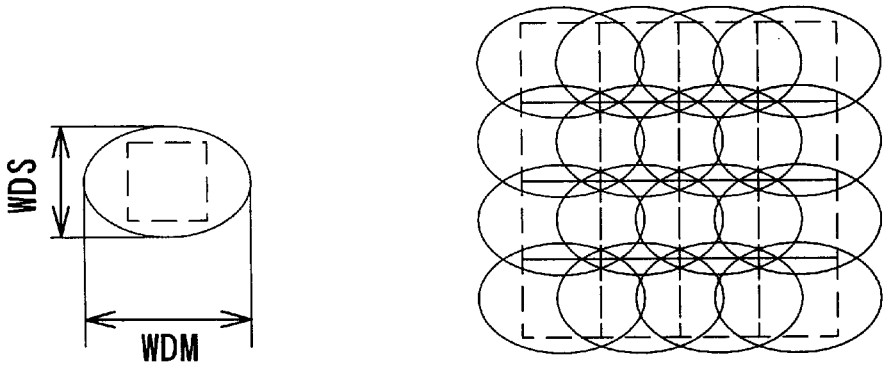
FIG. 17 shows the relationship between the flat dot and the resolution set by the prior art method.
Figure 18:
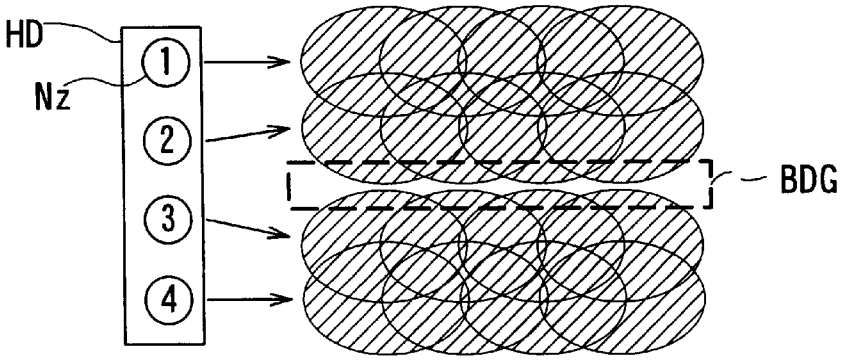
FIG. 18 shows an example of banding due to the creation of flat dots.

After the selection of the maximum density dot, the resolution in the sub-scanning direction is set, based on the size of the maximum density dot at step S20. As shown in FIG. 6, the larger-size dot is the flatter dot having the longer dimension in the main scanning direction. By taking into account the shape of the selected maximum density dot, the resolution in the sub-scanning direction is set, so as to prevent any clearance from being present between adjoining dots in the sub-scanning direction. FIG. 14 shows the relationship between the resolution and the shape of the dot.

In the drawing of FIG. 14, each ellipse of the solid line represents the maximum size dot, and each rectangle of the dotted line represents a pixel. In order to prevent any clearance from being present between adjoining dots in the sub-scanning direction, it is required to make a dot pitch PS in the sub-scanning direction narrower than a dimension WDS of the dot in the sub-scanning direction. Setting the resolution in the sub-scanning direction unequivocally determines the dot pitch PS. It is accordingly required to set the resolution in the sub-scanning direction that satisfies the above condition. There is a possibility of misalignment of the positions of dots created in the sub-scanning direction. The dot pitch PS should thus be set to be sufficiently smaller than the dimension WDS of the dot in the sub-scanning direction. The processing of step S20 sets the resolution in the sub-scanning direction, based on such discussion.

After setting the resolution in the sub-scanning direction, the program subsequently sets the resolution in the main scanning direction at step S30. The resolution in the main scanning direction is set, based on the size of the maximum density dot and the quantity of data transferred to the printer. The factor of the dot size has been discussed above in the step of setting the resolution in the sub-scanning direction. From this point of view, the resolution in the main scanning direction is set to make a dot pitch PM in the main scanning direction sufficiently smaller than a length WDM of the dot in the main scanning direction. The lower resolution results in the greater dot pitch PM. The lower limit of the resolution in the main scanning direction is determined by considering the size of the maximum density dot.

The quantity of data transferred to the printer should also be considered in the step of setting the resolution in the main scanning direction, with a view to ensuring a certain level of printing speed. The procedure first sets a target printing speed. In this embodiment, the target printing speed is a printing speed of a two-level printer that prints dots at a resolution of 720 dpi (dot per inch) both in the main scanning direction and in the sub-scanning direction. The binary data representing the on-off level of the dot per each pixel are supplied to the two-level printer at the time of the printing operation. The quantity of data required for printing per square inch is 518,400 bits. FIG. 15 shows the relationship between the resolution and the quantity of data.

One of the factors affecting the printing speed is the quantity of data transferred to the printer. Since the rate of transfer of data from the computer 90 to the printer 22 is restricted to a certain level, an increase in quantity of data transferred to the printer lowers the printing speed. In order to attain the target printing speed in the printer of the embodiment, the quantity of data should be not greater than 518,400 bits.

The printer 22 enables expression of the four levels or densities in each pixel. This means that 2 bit-data is required for each pixel to specify the state of dot creation. As shown in FIG. 15, the quantity of data transferred to the printer is regulated to the above level by setting the resolution in the main scanning direction to be not greater than 720 dpi when the resolution in the sub-scanning direction is set equal to 360 dpi or by setting the resolution in the main scanning direction to be not greater than 360 dpi when the resolution in the sub-scanning direction is set equal to 720 dpi. The upper limit of the resolution in the main scanning direction is determined according to the preset resolution in the sub-scanning direction by considering the quantity of data transferred.

Another factor affecting the printing speed is the number of passes of the main scan to complete each raster line. An increase in number of passes lowers the printing efficiency and thereby the printing speed. The lower limit of the number of passes is set according to the quantity of data required for each raster line. In the first example of FIG. 15, the number of passes of the main scan is equal to 1 when the resolution of 720 dpi is set both in the main scanning direction and in the sub-scanning direction. This means that data of one raster line are transferred to the printer in the course of one pass of the main scan. Namely 720 bit data per inch are transferred to each nozzle of the printer before one pass of the main scan is completed.

In the case of the printer 22 of the embodiment that requires the 2-bit data for each pixel, when the resolution in the main scanning direction is equal to 720 dpi, transfer of 1440 bit data per inch is required for each nozzle. The transfer of this quantity of data is not completed in the course of one pass of the main scan. Namely the required number of passes of the main scan is equal to 2 when the resolution in the main scanning direction is equal to 720 dpi. When the resolution in the main scanning direction is equal to 360 dpi, on the other hand, transfer of 720 bit data per inch is required for each nozzle. Namely the required number of passes of the main scan is equal to 1. The upper limit of the resolution in the main scanning direction is further decreased by taking into account the number of passes. In some cases, for example, in the case of overlap recording, however, an increase in number of passes is required to improve the picture quality. The number of passes may thus not be considered in the process of setting the resolution in the main scanning direction.

When a fixed quantity of ink is used to create each dot, the size of the dot depends upon the ink absorption capacity of the printing paper. In the printing paper that blots rather easily, such as standard paper, the resulting dots are relatively large in size. In the printing paper that has excellent ink absorption capacity, on the other hand, the resulting dots are relatively small in size. The difference in dot size naturally results in a variation in picture quality of the resulting printed image. The technique of this embodiment sets the resolution according to the procedure of FIG. 13 by taking into account the difference in ink absorption capacity of the printing paper as shown in FIG. 10. The user's requirement for the printing speed varies with a variation in picture quality of the resulting printed image. The technique of this embodiment accordingly changes the target printing speed for each type of the printing paper.

As described above, the technique of this embodiment sets the resolution in the sub-scanning direction according to the size of the dot and sets the resolution in the main scanning direction by taking into account the printing speed. Namely the different criteria are used to set the resolution in the sub-scanning direction and in the main scanning direction.

The printing apparatus of the embodiment discussed above uses flat dots, in order to enable expression of densities in a wide range in the respective pixels. This arrangement attains the high quality printing with excellent tone expression.

The printing apparatus of this embodiment carries out the printing operation at the preset resolution that depends upon the shape of the flat dot. More concretely the printing apparatus carries out the printing operation at the higher resolution in the sub-scanning direction, to which the smaller dot dimension is allocated, and at the lower resolution in the main scanning direction, to which the larger dot dimension is allocated. This technique enables the adjoining dots in the sub-scanning direction to be formed in a sufficiently overlapping manner. Even if there is misalignment of the positions of dot creation, this arrangement effectively prevents the occurrence of the banding. The technique of setting the lower resolution in the main scanning direction than the resolution in the sub-scanning direction desirably prevents the adjoining flat dots in the main scanning direction from being overlapped in an excessive manner and thereby prevents blotting and color mixing at the overlapped portions of the adjoining dots. The technique of setting the resolution in the main scanning direction by taking into account the printing speed, that is, the number of pixels included in the whole image, as well as the shape of the dot, favorably prevents an increase in quantity of data transferred to the printer 22 and thereby a decrease in printing speed. The printing apparatus of this embodiment accordingly attains the high quality printing at a high speed.

The above embodiment regards the printer 22 that creates flat dots having the longitudinal axis in the main scanning direction. The principle of the present invention is, however, also applicable to the printer that creates flat dots having the longitudinal axis in the sub-scanning direction. In the latter case, the resolution setting process sets the resolution in the main scanning direction according to the method of step S20 and sets the resolution in the sub-scanning direction according to the method of step S30.

Figure 19:
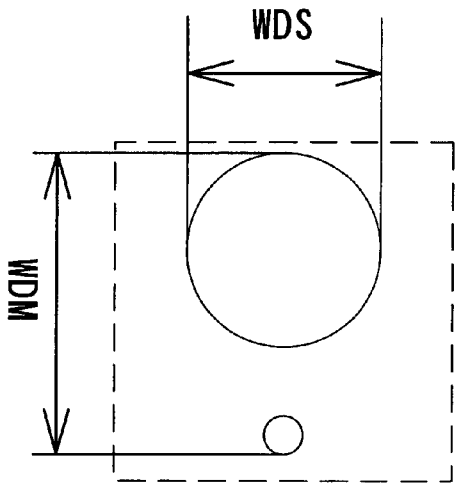
FIG. 19 shows one possible modification of the flat dot.
Figure 20:
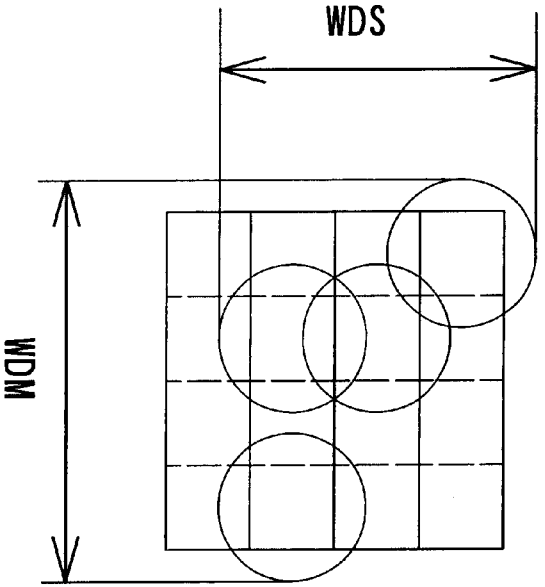
FIG. 20 shows another possible modification of the flat dot.

The principle of the present invention is also applicable to the case of two separate dots shown in FIG. 19 and to the case of dots for area tone expression shown in FIG. 20, where these dots are regarded as the flat dots of the above embodiment.

The above embodiment regards the ink jet printer with the piezoelectric elements. The principle of the present invention is, however, applicable to a variety of printers and printing apparatuses, for example, a printer that supplies electricity to a heater connected to nozzles and utilizes bubbles generated in the heated ink for ink ejection.

The present invention is not restricted to the above embodiment or its modifications, but there may be many other modifications, changes, and alterations without departing from the scope or spirit of the main characteristics of the present invention. For example, the variety of control procedures discussed in the above embodiment may partly or totally be actualized by the hardware configuration, instead of the software programs.

The scope and spirit of the present invention are limited only by the terms of the appended claims.

What is claimed is:

1. A printing apparatus that forms dots on a printing medium at a preset resolution in pixels arranged in a two-dimensional array, thereby printing an image on the printing medium, said printing apparatus comprising:

a print head that forms each dot of the two-dimensional array on the printing medium;

a data setting unit that sets image data at the preset resolution; and a dot creation unit that drives said print head based on the image data set by said data setting unit so as to form the dots of the two-dimensional array on the printing medium at the preset resolution, with at least some of the dots being formed as a flat dot having a significantly smaller maximum dimension in a first direction of the two-dimensional array than a maximum dimension in a second direction of the two-dimensional array, wherein the present resolution is set in the first direction to satisfy a condition that an interval between adjoining dots on the printing medium in the first direction does not exceed the maximum dimension of the flat dot in the first direction, and is set in the second direction to satisfy a condition that an interval between adjoining dots in the second direction does not exceed the maximum dimension of the flat dot in the second direction and that the preset resolution in the second direction is lower than the preset resolution in the first direction.

2. A printing apparatus in accordance with claim 1, wherein said dot creation unit drives said print head to form at least two dots that have different areas on said print medium with the flat dot being formed as a dot of maximum area.

3. A printing apparatus in accordance with claim 1, said printing apparatus further comprising:

a main scanning unit that moves said print head relative to said printing medium forward and backward in a predetermined direction; and a sub-scanning unit that moves said printing medium relative to said print head in another direction that crosses the predetermined direction, wherein the predetermined direction is coincident with the second direction, and the another direction is coincident with the first direction.

4. A printing apparatus in accordance with claim 1, wherein the preset resolution in the second direction is set to satisfy a condition that a quantity of data for specifying a dot on-off level with regard to all the pixels included in the image having a predetermined size is not greater than a predetermined value based on printing speed.

5. A printing apparatus in accordance with claim 1, wherein each flat dot is formed by said dot creation unit driving said print head a plurality of times with a corresponding plurality of pulses with regard to each pixel.

6. A printing apparatus in accordance with claim 1, wherein said data setting unit sets image data at the preset resolution according to an error diffusion method diffusing divisions of an error both in the first direction and in the second direction without any extreme difference.

7. A printing apparatus in accordance with claim 1, said printing apparatus further comprising:

a storage unit that stores a different preset resolution for each of a plurality of different types of printing medium; and a detection unit that detects the type of printing medium the dots are to be printed on, wherein the preset resolution is set according to the type of printing medium detected by the detection unit by referring to said storage unit.

8. A printer that forms dots in a two-dimensional array on a printing medium and thereby prints an image on the printing medium, said printer comprising:

a print head that forms at least two different dots having different areas in the two-dimensional array on the printing medium; and a driving unit that drives said print head to form the at least two different dots with a preset resolution in the two-dimensional array on the printing medium, said at least two different dots being further formed by the driving unit to include first dots having a maximum area and second dots having an area smaller than said maximum area, said first dots being formed on the printing medium so as to have a significantly smaller maximum dimension in a first direction of the two-dimensional array than a maximum dimension in a second direction of the two-dimensional array, wherein the preset resolution is set in the first direction to satisfy a condition that an interval between adjoining dots in the first direction does not exceed the maximum dimension of the first dots in the first direction, and is set in the second direction to satisfy a condition that an interval between adjoining dots in the second direction does not exceed the maximum dimension of the first dots in the second direction and that the preset resolution in the second direction is lower than the preset resolution in the first direction.

9. A method of forming dots on a printing medium at a preset resolution in pixels arranged in a two-dimensional array and thereby printing an image on the printing medium, with a print head that forms at least two different dots having different areas, the at least two different dots including first dots having a maximum area and a significantly smaller maximum dimension in a first direction of the two-dimensional array than a maximum dimension in a second direction of the two-dimensional array, said method comprising the steps of:

(a) setting image data at the preset resolution; and (b) driving said print head based on the image data set in said step (a) to form the at least two different dots including said first dots on said printing medium in said two-dimensional array with the preset resolution;

wherein the preset resolution is set in the first direction to satisfy a condition that an interval between adjoining dots in the first direction does not exceed the maximum dimension of the first dots in the first direction, and is set in the second direction to satisfy a condition that an interval between adjoining dots in the second direction does not exceed the maximum dimension of the first dots in the second direction and that the preset resolution in the second direction is lower than the preset resolution in the first direction.

* * * * *